US008290197B2

(12) United States Patent
Buining et al.

(10) Patent No.: US 8,290,197 B2
(45) Date of Patent: Oct. 16, 2012

(54) ELECTROSTATIC SPEAKER SYSTEMS AND METHODS

(75) Inventors: Ronald Buining, Zeist (NL); Gaston Bastiaens, Westerlo (BE); Hidde de Haan, Jomtien (TH); Ton Hoogstraaten, SE Maarheeze (NL); Uwe Kempe, Lemgo (DE); Karl-Heinz Fink, Essen (DE); James Tuomy, Framingham, MA (US)

(73) Assignee: Transparent Sound Technology B.V. (NL)

( * ) Notice: Subject to any disclaimer, the term of this patent is extended or adjusted under 35 U.S.C. 154(b) by 481 days.

(21) Appl. No.: 12/435,884

(22) Filed: May 5, 2009 (Under 37 CFR 1.47)

(65) Prior Publication Data

US 2010/0272309 A1 Oct. 28, 2010

Related U.S. Application Data

(60) Provisional application No. 61/050,489, filed on May 5, 2008, provisional application No. 61/050,897, filed on May 6, 2008.

(51) Int. Cl.
*H04R 1/02* (2006.01)

(52) U.S. Cl. ..... 381/394; 381/399; 381/191; 381/303; 381/398

(58) Field of Classification Search ..... 381/399, 381/394, 191, 303, 398
See application file for complete search history.

(56) References Cited

U.S. PATENT DOCUMENTS

| | | | | |
|---|---|---|---|---|
| 1,759,811 | A | 5/1930 | Edelman | |
| 3,562,429 | A | 2/1971 | West | |
| 5,901,235 | A * | 5/1999 | Thigpen et al. | 381/431 |
| 6,760,462 | B1 * | 7/2004 | Thigpen | 381/431 |
| 8,085,969 | B2 * | 12/2011 | Simidian et al. | 381/399 |
| 2001/0043046 | A1 * | 11/2001 | Fukunaga | 315/160 |
| 2007/0189559 | A1 | 8/2007 | Haan et al. | |

OTHER PUBLICATIONS

Authorized Officer—Pieter Nieuwenhuis, International Search Report; PCT/US2009/042863; Dec. 9, 2009.

* cited by examiner

*Primary Examiner* — Tu-Tu Ho
(74) *Attorney, Agent, or Firm* — Kaplan Breyer Schwarz & Ottesen, LLP

(57) ABSTRACT

An electrostatic speaker system including at least one electrostatic speaker element having a pair of stators and a diaphragm therebetween, each of the stators and the diaphragm having an least one electrically conductive portion. The conductive portion of the diaphragm is patterned as a mesh, which may include gaps, and a conforming layer overlying the conducting portion of the diaphragm and disposed so as to cover gaps in the mesh. A speaker drive circuit provides soft clipping of the audio input signal so that the audio signal applied between the diaphragm and the stators does not exceed the maximum acceptable level that can be applied between the diaphragm and the stators of at least one speaker element.

7 Claims, 17 Drawing Sheets

| | | Electrostatic Speaker M1 | | | | | | | Electrostatic Speaker M2 | | | | | | |
|---|---|---|---|---|---|---|---|---|---|---|---|---|---|---|---|
| Fixed for Each Satellite | | HP | HP | PEQ | PEQ | Low Shelf | High Shelf | Delay | HP | HP | PEQ | PEQ | Low Shelf | High Shelf | Delay |
| | | Highpass 2. Order BU 170Hz | Not used | Notch 1400Hz K= -3dB Q=4.0 | Notch | Low Shelving Filter | High Shelf | Delay Satellite | Highpass 2. Order BU 180Hz | Not used | Notch 1500Hz K=3dB Q=10 | Notch | Low Shelving Filter | | Delay Satellite |
| Depending on Location Setting in OSD | ca. 0.5-1m | 550Hz K=1.5dB Q=3 | | | | | | | 700Hz K=1.5dB Q=3 | | | | | | |
| | ca. 1-1.5m | 350Hz K=1dB Q=3 | | | | | | | 700Hz K=0.5dB Q=3 | | | | 200Hz K=1dB S=0.9 | | |
| | .1.5m for F400i .1.7m | 200Hz K=+3dB S=0.9 | | | | | | | 200Hz K=3dB S=0.9 | | | | | | |
| Depending on High Frequency Room Damping | | Highshelf 5050Hz K=+2dB S=0.7 | | | | | | | Highshelf 5050Hz K=+2dB S=0.7 | | | | | | |
| Small Subwoofer | | no | | | | | | | no | | | | | | |
| S110 Subwoofer | | no | | | | | | | ca. 0.4-0.5 ms | | | | | | |
| S220 Subwoofer | | no | | | | | | | no | | | | | | |

*FIG. 14A*

| | | Electrostatic Speaker M3 | Electrostatic Speaker M4 |
|---|---|---|---|
| Fixed for Each Satellite | | HP (Highpass 2. Order 170Hz Q1=1.0) – HP (3. Order 1. Order 170Hz) – PEQ (Not used) – PEQ (Notch) – Low Shelf – High Shelf – Delay (Delay Satellite) | HP (Highpass 4. Order 2. Order 130Hz Q1=0.541 2. Order 130Hz Q2=1.307) – HP – PEQ (Notch 900Hz K=2dB Q=4) – PEQ (Notch) – Low Shelf – High Shelf – Delay (Delay Satellite) |
| Depending on Location Setting in OSD | ca. 0.5-1m | 175Hz K=1.5dB S=1.0 | 175Hz K=2.5dB S=1.0 |
| | ca. 1-1.5m | | |
| | >1.5m for M4 >1.7m | 175Hz K=6dB S=1.0 | 175Hz K=6dB S=1.0 |
| Depending on High Frequency Room Damping | | Highshelf 5050Hz K=+2dB S=0.7 | Highshelf 5050Hz K=+2dB S=0.7 |
| Small Subwoofer | | no | no |
| S110 Subwoofer | | no | ca. 1ms |
| S220 Subwoofer | | no | no |

*FIG. 14B*

ELECTROSTATIC SPEAKER SYSTEMS AND METHODS

CROSS-REFERENCE TO RELATED APPLICATIONS

This application claims priority from U.S. Provisional Patent Application Nos. 61/050,489 filed on May 5, 2008 and 61/050,897 filed on May 6, 2008, a disclosure of each of which is incorporated herein in its entirety.

TECHNICAL FIELD

The present invention relates to electrostatic speaker systems, and more particularly to systems of electrostatic speakers and electronic arrangements for driving them.

SUMMARY OF THE INVENTION

In a first embodiment of the invention there is provided an electrostatic speaker including first and second stators and a diaphragm disposed therebetween, each of the stators and the diaphragm having an electrically conductive portion, wherein the conductive portion of the diaphragm is patterned as a mesh. In a further related embodiment, the mesh includes gaps, and the system further includes a conforming layer overlying the conducting portion of the diaphragm, and disposed so as to cover gaps in the mesh. Optionally the conforming layer is characterized by resistivity of at least $10^8$ Ohms per square or higher. Also optionally, the conductive portion of the diaphragm is formed by printing on the diaphragm a conductive ink of having very finely divided conductive pigment particles in a thermoplastic resin. Optionally, the diaphragm has a highly conductive line along the border of the conductive portion of the diaphragm, the highly conductive line formed thereon by printing. In a related embodiment, there is provided an electrostatic speaker system that includes a pair of electrostatic speaker elements, each element having first and second stators and a diaphragm disposed therebetween. For each element, each of the stators and the diaphragm has an electrically conductive portion, and the conductive portion of each diaphragm is patterned as a mesh. A first one of the elements is coupled to an input filtered to provide audio signals in a first frequency range and a second one of the elements is coupled to an input filtered to provide audio signals in a second frequency range, the first frequency range lying above the second frequency range. In this embodiment, the conductive portion of the diaphragm of the first element has lower resistance per square than the conductive portion of the diaphragm of the second element. Optionally the conductive portion of the diaphragm of the first element has a finer mesh pattern than the conductive portion of the diaphragm of the second element.

In another embodiment, the invention provides an electrostatic speaker system including at least one electrostatic speaker element having a pair of stators and a diaphragm therebetween, each of the stators and the diaphragm having an least one electrically conductive portion. In this embodiment, the at least one speaker element has a maximum acceptable audio signal level than can be applied between the diaphragm and the stators. The embodiment includes a speaker drive circuit, having an (i) output coupled to the at least one speaker element, that supplies the audio signal and (ii) an audio input for receiving an audio input signal. The speaker drive circuit provides soft clipping of the audio input signal so that the audio signal applied between the diaphragm and the stators does not exceed the maximum acceptable level.

Optionally, the speaker drive circuit includes at least one MOSFET transistor, and the speaker drive circuit may be implemented with a pair of MOSFET transistors connected in an anti-serial configuration in relation to the output of the drive circuit. As a further option, gates of the MOSFET transistors are fed by a signal reflecting the difference between a soft-clipped dc reference derived from the audio input signal to the drive circuit and a second dc signal derived from the output of the drive circuit.

In another embodiment, the invention provides an electrostatic speaker system including at least one electrostatic speaker element having first and second stators and a diaphragm disposed therebetween, each of the stators and the diaphragm having an electrically conductive portion, wherein the speaker element has a high frequency limit in its frequency response to an audio input. This embodiment further includes a decorative perforated plate disposed next to one of the stators. The perforated plate is spaced apart from the one of the stators by an amount less than a half-wavelength of the high frequency limit and has through-holes having a local hole density and size range defined so as to render the perforated plate substantially sound-transparent. Optionally, the electrically conductive portion of the diaphragm is patterned as a mesh.

In another embodiment, the present invention provides an electrostatic speaker system including first and second stators, each of the stators having an electrically conductive portion; and a diaphragm disposed between the stators and having a first and a second electrically conductive portions disposed on the opposite surfaces of the diaphragm. Optionally, the first and the second electrically conductive portions of the diaphragm are electrically connected so as to keep both conductive portions at an equal electric potential. Also optionally, at least one of the first and the second conductive portions is patterned as a mesh.

In yet another embodiment, the invention provides an electronics system for connection to an electrostatic speaker system, such speaker system having an approximately dipole sound radiation pattern and located in a listening room at a distance from a back wall. In this embodiment, the system includes an amplifier having an output for connection to the electrostatic speaker system. It also includes a compensation system coupled to the amplifier, such compensation system (i) providing filtering that can compensate for effects attributable to the approximately dipole radiation pattern of the electrostatic speaker system in the room and (ii) having parameters that are adjustable in accordance with a series of user adjustable settings. Finally, the embodiment includes a user interface coupled to the compensation system for specifying the user adjustable settings. The user adjustable settings include the distance of the speaker system from the back wall. Optionally, the electrostatic speaker system is of a specific model and the user adjustable settings include an identifier for the specific model. Also optionally, the room includes a floor and the user adjustable settings include positioning of the speaker system among choices including on the wall and on the floor along the wall. As a further option, the room includes a corner and the user adjustable settings include positioning of the speaker system among choices further including in a corner. As yet a further option, the room has a listener position and the user adjustable settings include distance of the speaker system from the listening position.

In another embodiment, the invention provides an electrostatic speaker system including a pair of electrostatic speaker elements, each element having first and second stators and a diaphragm disposed therebetween, a surface of the diaphragm defining a plane for the element of which it is a component. For each element, each of the stators and the diaphragm has an electrically conductive portion. A first one of the elements is coupled to an input filtered to provide audio signals in a first frequency range and a second one of the elements is coupled to an input filtered to provide audio signals in a second frequency range, the first frequency range lying above the second frequency range. The elements are mounted in a structure with respect to each other so that their planes form a dihedral angle. Optionally, the dihedral angle is variable so that the speaker elements can be adjusted at an angle relative to one another according to environmental characteristics of a room in which they can be situated. Also optionally, the dihedral angle includes a vertex and the structure includes a hinge at the vertex. As a further option, the structure includes a clamp to fix the dihedral angle at a desired setting for the room.

BRIEF DESCRIPTION OF THE DRAWINGS

The foregoing features of the invention will be more readily understood by reference to the following detailed description, taken with reference to the accompanying drawings, in which:

FIGS. 14A and 14B respectively list exemplary parameters of an AV-receiver for speaker models M1-M2 and M3-M4.

DETAILED DESCRIPTION OF SPECIFIC EMBODIMENTS

Figure 1:
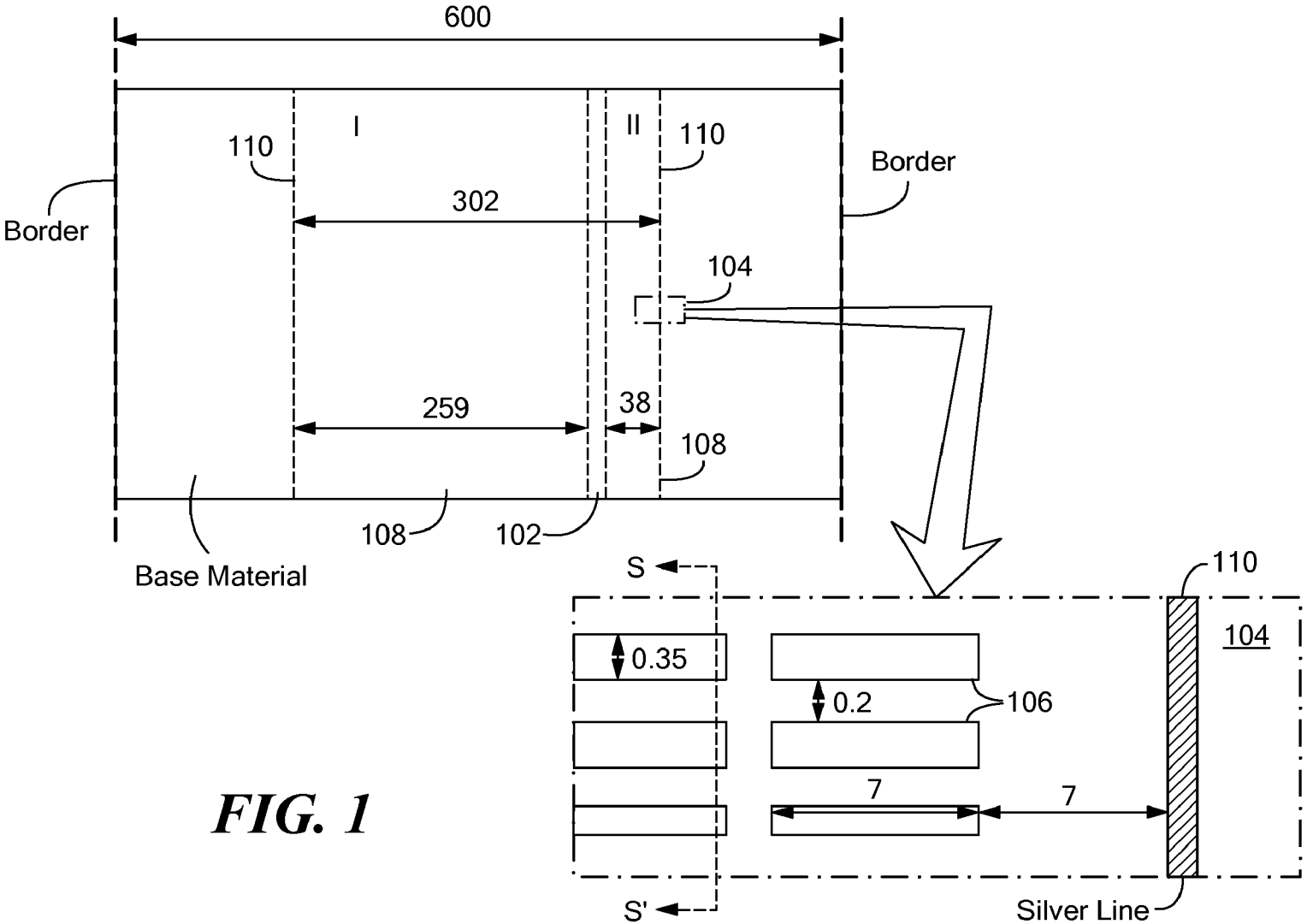
FIG. 1 shows schematically a layout of a conductive layer of the speaker diaphragm patterned as a mesh, according to one embodiment of the invention.

Definitions. As used in this description and the accompanying claims, the following terms shall have the meanings indicated, unless the context otherwise requires:

A "mesh" pattern in the conductive layer of a diaphragm means a pattern (however arranged) of gaps, in the conductive layer, that in the aggregate occupy a significant fraction of the area of the conductive layer. The pattern may be random or it may be repetitive. Each gap may, but need not, be rectangular. In a case where the pattern is repetitive, it need not necessarily have a uniform frequency of repetition.

"Soft clipping" of an input signal by a system means the system provides an output, in relation to the input, that is nonlinearly scaled. In particular, when the input signal falls within a range of amplitude between zero and a first threshold, the system provides a uniform level of gain, and when the input signal exceeds the first threshold, the system gain is tapered lower as a function of amplitude of the input signal. Typically the taper is developed (and therefore the gain is adjusted) so as to prevent the output from exceeding a specified level.

The present invention provides improvements to electrostatic speaker systems of the type disclosed in our published PCT application WO 2007/081584, entitled Electrostatic Loudspeaker Systems and Methods, which is hereby incorporated herein by reference as "Our Prior Application".

Diaphragm with a Conductive Layer Mesh

In one of the embodiments of the invention herein, each of the diaphragm's conductive layers includes a mesh to reduce the mass of the diaphragm (and thereby, among other things, to improve its responsiveness) and consumption of materials used in the diaphragm. As compared to a continuous conductive layer embodiment described in Our Prior Application, a reduction of the area of the diaphragm's conductive layers due to structuring it as mesh also reduces effects of capacitive low-pass filtering that arise from a parasitic capacitance, formed by the conductive layers and the stators and non-uniformly distributed across the area of the speakers. In a further specific embodiment, we employ a rectangular mesh—as compared to an alternative horizontally striped pattern, for example—to reduce risks arising from open circuits created by printing errors. In other words, a serious printing defect in a striped mesh that spans the distance between contacts along the edges of the diaphragm (such as contacts along the silver line shown as item 81 in FIG. 8 in Our Prior Application) might prevent the stripe carrying the defect from receiving an electrical signal and therefore prevent the stripe from contributing to the conversion of electrical signal to sound. On the other hand, where the mesh is rectangular, of course, each horizontal stripe is traversed by a series of vertical stripes. Accordingly, with a rectangular mesh the hypothesized printing defect is circumvented by the prospect that the relevant horizontal stripe at a series of locations can receive the electrical signal from an adjacent horizontal stripe via any of the intersecting vertical stripes.

Figure 6:
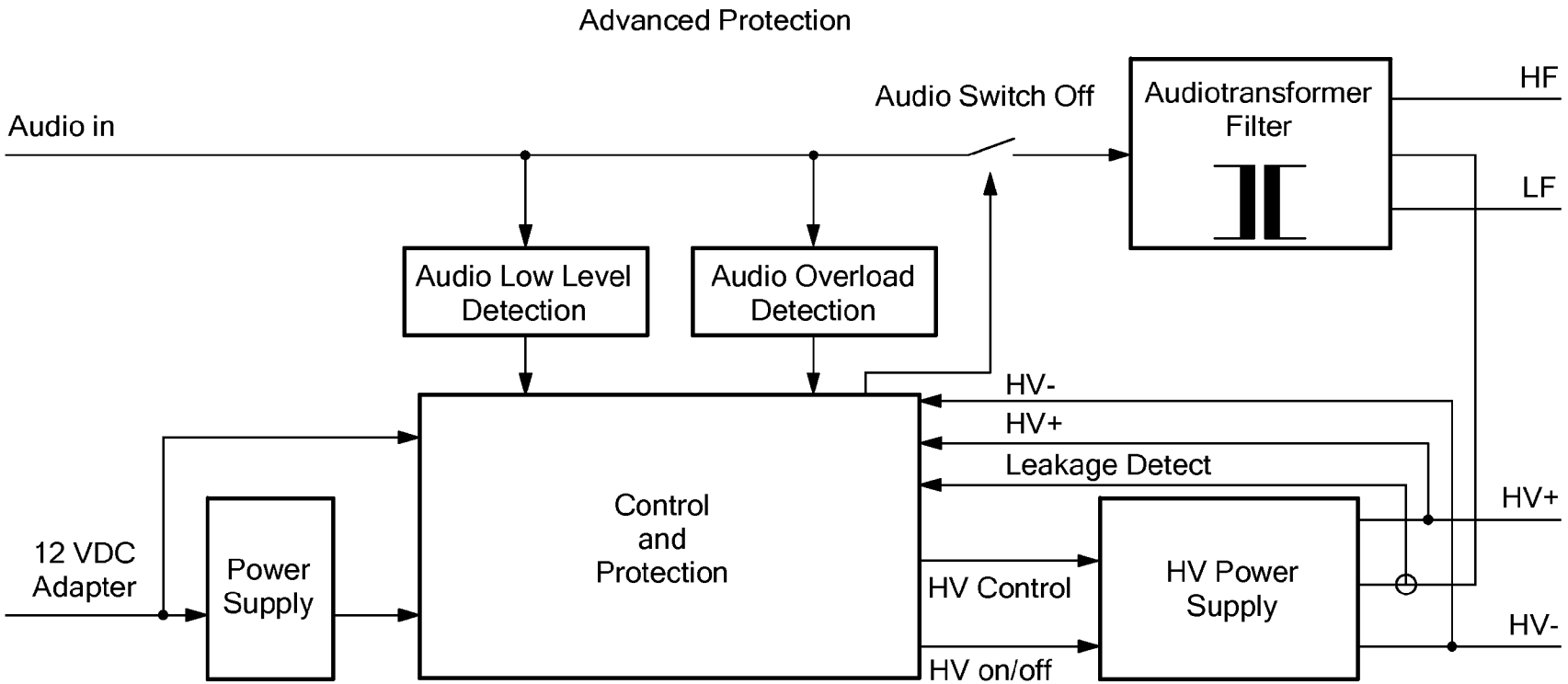
FIG. 6 illustrates an embodiment of the invention providing programmable advanced protection to an electrostatic speaker.

An example of such a mesh-patterned embodiment is presented in FIG. 1, schematically illustrating a portion of the two abovementioned conductive sections, I and II, of the diaphragm. These sections I and II are used for low- and mid-frequency tones on the one hand, and high-frequency tones on the other, and correspond to the wide and narrow sections shown in the diaphragm of FIG. 6 of Our Prior Application. In practice, the diaphragm of FIG. 1 of this application may be seamlessly printed in a mass-production cycle on an underlying layer of base material (such as mylar) and later cut into single diaphragm-preforms along borders indicated in dashed line. The two conductive sections are electrically separated by a non-conductive gap 102 (which, in the example of FIG. 1, is 5 mm wide). In other embodiments, at least one of the conductive portions of the diaphragm foil is patterned as a mesh. In addition or alternatively, a plurality of conductive sections separated by non-conductive gaps can be used that correspond to production of sound in different frequency ranges and address different filtering. In other related embodiments, there may be provided a diaphragm set comprising several diaphragms, each diaphragm having a conductive section, each diaphragm from the diaphragm set associated with production of sound in a distinct frequency range.

Although a variety of mesh patterns may be generally chosen, a rectangular or square mesh may be preferred to simplify printing processes. An example of a mesh-pattern is shown in insert 104 of FIG. 1, where the mesh-pattern of a conductive foil 108, indicated by hatching, is formed by periodically printed horizontal and vertical conductive stripes. As shown in insert, the conductive stripes are separated with gaps 106 having exemplary dimensions of about $0.35\times7$ mm$^2$. In a specific embodiment, we have obtained satisfactory results making the conductive portion of the mesh occupying about 40% of the total area of the diaphragm (including both conductive and non-conductive regions). The outer regions of the conducting areas I and II, however, are preferably fully printed to facilitate electrical contact of the mesh with the silver line 110 and therefore with the audio signal. (The silver line 110 corresponds to the silver line 81 of FIG. 8 in Our Prior Application.)

The mesh-patterns can be judiciously varied, locally or otherwise, to provide for a performance as desired. For example, choosing of the shape of mesh-elements can be used to define and control the spatial radiation patterns produced by the diaphragm portions.

In addition, modification of the resistance of the mesh may be advantageously used, for example, to decrease resistance in the high-frequency section of the diaphragm, so as to reduce effects arising from parasitic capacitance. To this end, in some embodiments of the invention the conductive foil layer may be so patterned as to provide for resistance values of about 100 Ohms per unit area of the conductive foil in the high frequency section of the diaphragm and about 1 MOhm per unit area in the low- and mid-frequency section.

In a further related embodiment, some or all of the mesh pattern of a diaphragm may be coordinated so as to correspond in some fashion to the pattern of perforations associated with the stators; such an arrangement may efficiently develop electrostatic forces from electrical power applied to the diaphragm relative to the stators. In one embodiment, the pattern of perforations has the same spatial frequency as that of the mesh pattern. In a related embodiment, the pattern of perforations has a spatial frequency that is a multiple of the spatial frequency of the mesh. Alternatively, the spatial frequency of the perforations may be an odd half harmonic of the spatial frequency of the mesh, so as to avoid problems of alignment of the perforations with the mesh.

It will also be appreciated that local variations of the pattern of the mesh may be used to advantageously affect the distribution of an acoustic radiation pattern. For example, a more open mesh near the edges of the diaphragm section may be employed to reduce electrostatic forces applied by the stators in these regions to as to affect the radiation pattern and to reduce stress near the edges of the diaphragm.

Figure 2:
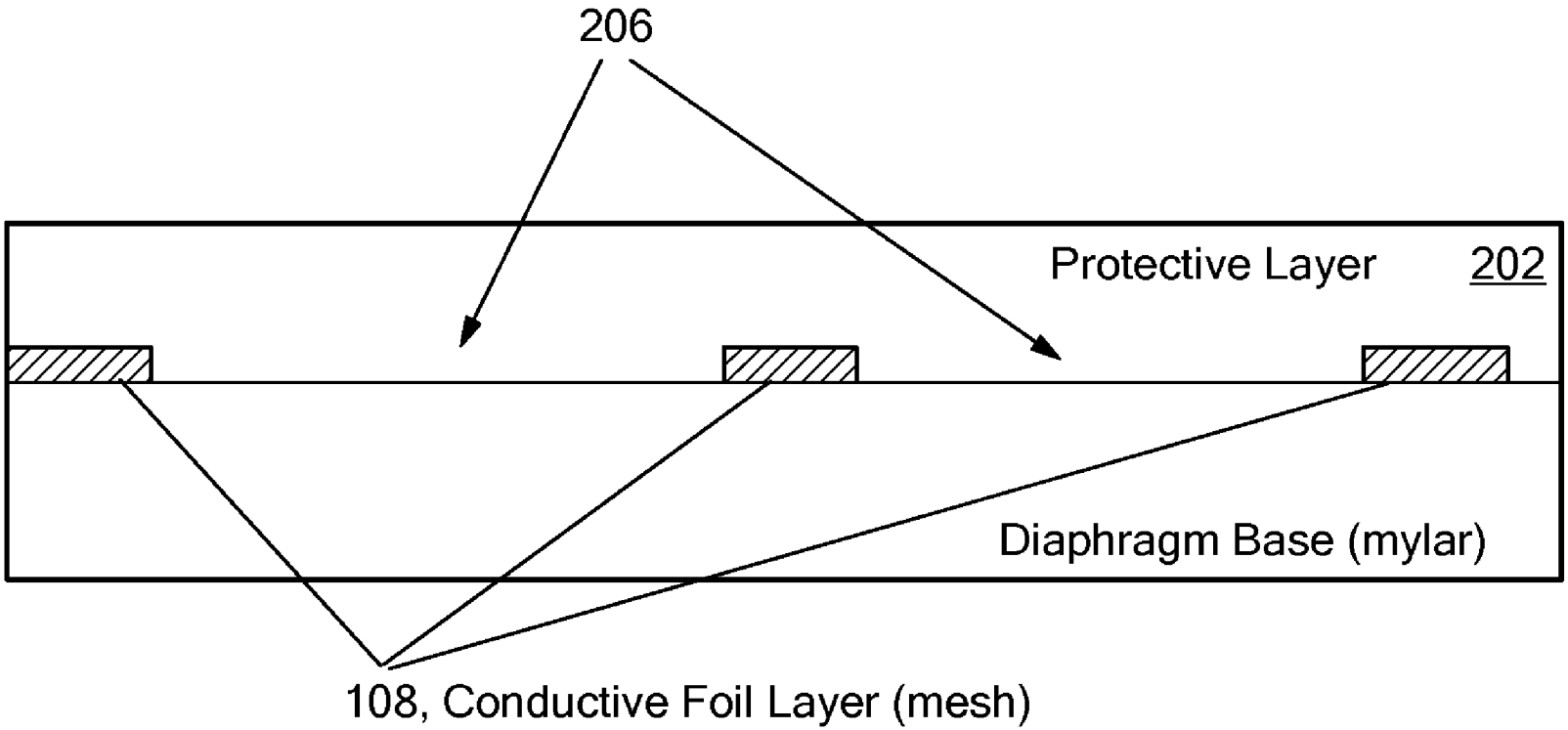
FIG. 2 illustrates a limited cross-section of the diaphragm of the embodiment of FIG. 1.
Figure 7A:
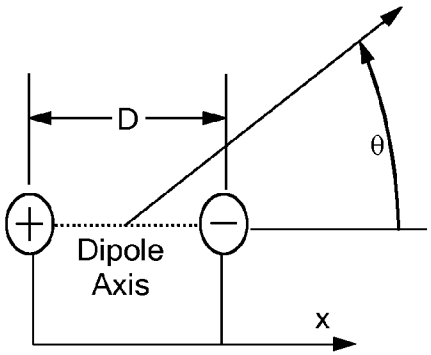
FIG. 7 schematically presents (A) a bidirectional source (dipole), (B) a normalized frequency response, $|H(D/\lambda)|$, of the dipole at an angle $\Theta=0$, and (C) polar directivity pattern, $|R(\Theta)|$, of the dipole.
Figure 7B:
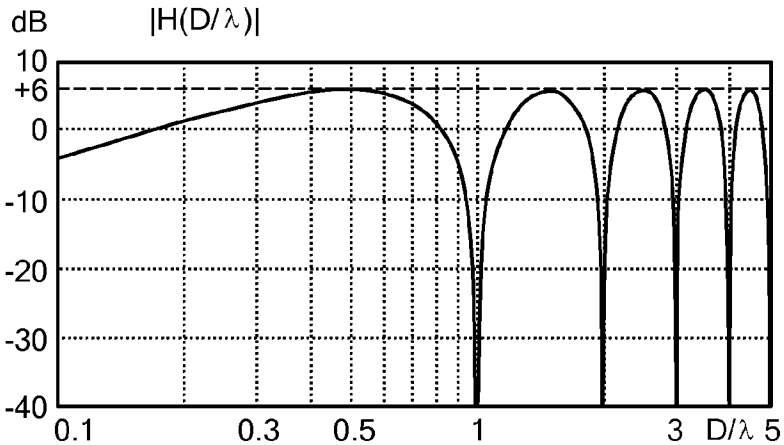

Moreover, mesh-dimensions may be judiciously chosen to provide for difference impedance drive for the sections of the diaphragm associated with different spectral content of the generated acoustic field. For example, to provide for low impedance drive (determined by the required low capacitive load) at high-frequencies, the high-frequency section of the diaphragm may comprise a finer mesh, thus being characterized by lower resistance values. In comparison, the mesh of the diaphragm associated with a low-frequency section may be structured in a coarse fashion and be bigger. Furthermore, a conformal layer protecting the conductive foil (and indicated as protective layer in embodiment of FIG. 7) may be employed to facilitate the use of coarser, bigger mesh in the low-frequency section of the diaphragm. To this end, as shown in FIG. 2 in a cross-sectional view S-S' of the embodiment of FIG. 1, a conformal protective dielectric layer 202, judiciously chosen to possess antistatic properties and high resistivity, may be deposited on the conductive mesh 108 so as to fill the voids 106 of the mesh as well as the non-conductive gap 102. Such protective layer, which in some embodiments may be acrylate-based and have resistivity on the order of $10^8 \ldots 10^9$ Ohms, may allow for fabrication of the diaphragm mesh from a material with increased conductivity. In some embodiments, the electrically conductive portion of the diaphragm may be formed by printing on the diaphragm a conductive ink of the type having very finely divided conductive pigment particles in a thermoplastic resin, such as a carbon-based ink such. Additionally, the conforming protective layer may reduce current leakage across the mesh-gaps.

Different sections of the diaphragm may be oriented adjacent to each other and in any order. In one embodiment, however, the different sections are arranged in order of increasing frequency bands for which the sections are adapted, so as to provide a mirror like arrangement in the case of two loudspeakers for generating a stereo sound field. A further benefit of such arrangement lies in the prospect of employing progressively small stator-to-diaphragm spacing with sections having progressively higher frequency bands, in the manner previously discussed. Other arrangements are not excluded, like arranging the different sections in a clockwise or anticlockwise fashion in a plane. In some specific embodiments, for example, the rectangular mesh pattern of the conductive layer of the diaphragm may be rotated at a pre-determined angle such as 45 degrees, for example, with respect to the direction of the elongation of the diaphragm, which increases the foil's resistance to mechanical tensions and stresses arising due to diaphragm deformations.

Diaphragm with an Antistatic Layer

Figure 3B:
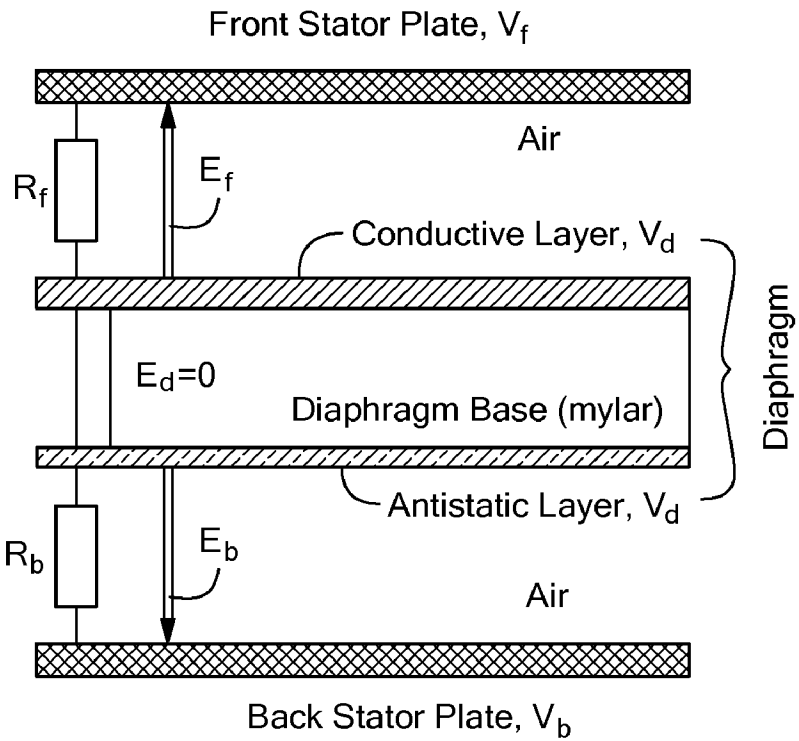
FIGS. 3A and 3B show implementations of a diaphragm respectively without, and with, an antistatic layer in accordance with a further related embodiment of the present invention.
Figure 3A:
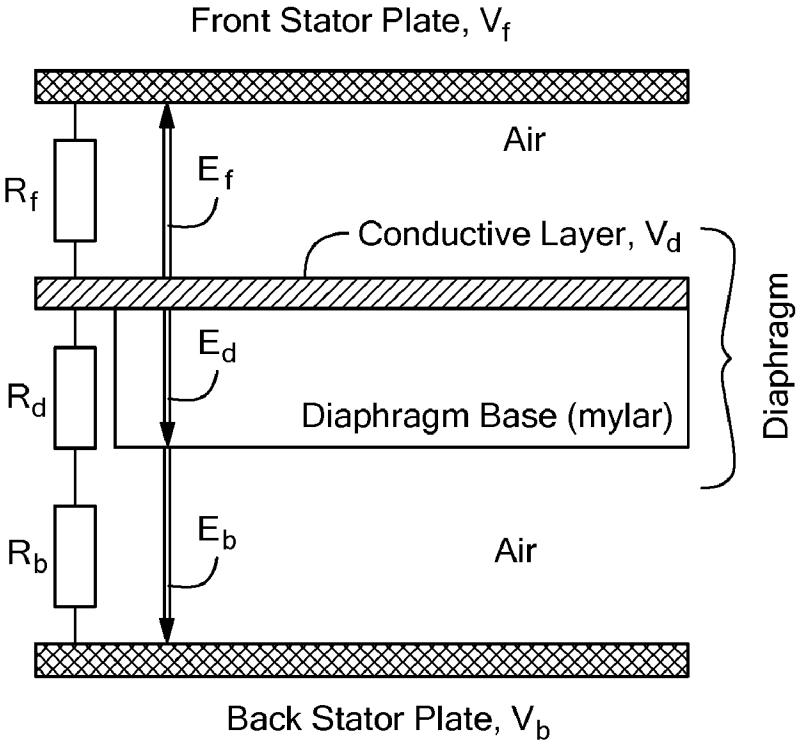

Conventionally, implementations of the diaphragm comprise a single conductive layer disposed on the diaphragm substrate, as shown in the schematic of an electrostatic speaker element of FIG. 3A, comprising a front stator plate at an electric potential $V_f$, a diaphragm with a conductive layer at a potential $V_d$, and a back stator plate at a potential $V_b$. As will be understood by a skilled artisan, in operation such a structure generally does not create equal DC electric fields, $E_f$ and $E_b$, in the equal air gaps, respectively separating the diaphragm from the front and back stator plates because the diaphragm base has a non-zero resistance $R_d$. Therefore, a fraction of the electrostatic field $E_d$ penetrating the mylar base is not utilized for the purposes of driving the diaphragm to produce sound. The discrepancy between the strength of the fields $E_f$ and $E_b$ driving the diaphragm will depend in part on the resistivity of the air, and, under normal conditions, constitute about 10% to 20% (which approximately corresponds to $R_d \sim 0.25R_f$). Consequently, in operation the diaphragm foil tends to curve in the direction of the front stator plate, thus leading to some sound distortion and clipping and reducing the maximum achievable sound output. Moreover, because of such mechanical distortion, the electrostatic speaker has a reduced sensitivity as compared to a theoretical limit. Furthermore, in an extreme situation, when the speaker has to operate in a moist environment, the air resistance can be reduced to a level below $R_d$ that detrimentally affects the performance of the speaker.

To address this problem and improve the performance of the electrostatic speaker, in one embodiment of the current invention a lightly conducting, an antistatic layer is disposed on the back surface of the diaphragm base, opposite to the conductive layer, as shown in FIG. 3B. In some related embodiments, the resistance of the antistatic layer may be between 5 and 50 MOhm per unit of area. The conductive layer and the antistatic layer are electrically connected, keeping both layers at the same DC potential $V_d$. As a result, in operation, the effective electrostatic field penetrating the diaphragm base is minimized and the deformation of the diaphragm with respect to the front and the back stator plates is optimized to increase the maximum sound level delivered by the electrostatic speaker, as well as the speaker sensitivity, by several dB. It will be appreciated that the antistatic layer may be continuous or patterned as a mesh that may be equivalent to or different from the mesh of a conductive layer.

Perforated Front Grill

Embodiments of an electrostatic speaker of the current invention may include a decorative perforated plate that is used as a protective covering of the stators and diaphragm that does not alter the intrinsic performance of the embodiments of the invention in any significant way. In one embodiment, such plate is disposed next to one of the stators at a distance not exceeding a half-wavelength in air of sound at 20 kHz (or if the speaker's frequency response has a lower high-frequency limit, then at the high-frequency limit of the speaker's response), is metallic, and has through holes with a local hole density and size range defined so as to make the perforated plate substantially transparent to sound generated by the electrostatic speaker. In a specific embodiment, the decorative plate is made of a steel or aluminum sheet that is thinner than about 0.8 mm and is perforated with round through holes of about 3 mm in diameter occupying at least 55% or 60% of the total area of the plate.

In another related embodiment, the decorative plate may be structured as a grille, i.e. a metallic plate containing opening of several slits disposed in the plate side by side and occupying more than about 55% of the total area of the plate.

Soft clipping, Protection and Safety Features

Various embodiments of the invention provide an audio protection circuit operating in conjunction with the audio filter and the DC high voltage power source. Our Prior Application describes such protection circuits in connection with FIGS. 25-29 on pages 24-31. These circuits operate, under circumstances of an audio overload situation, to disable the audio signal connection to the electrostatic speaker. Of course, under such circumstances, when signal is removed altogether from the speaker, the speaker will cease producing sound during the time of removal, and the listener can notice such an effect, which can fairly be called "hard clipping" of the signal. In some embodiments of the present invention, this disadvantageous listener situation is avoided under various circumstances by using soft-clipping to deal with audio overload on the speaker. In particular, soft clipping is used to provide a graduated attenuation when the audio signal exceeds specified limits and is tailored to provide attenuation in a manner permitting (i) maximum sound output from the electrostatic speaker without harm to the speaker, (ii) without interruption of the sound, and (iii) while minimizing listener perception of any signal attenuation.

Soft clipping implementations are described in a number of references, including in U.S. Pat. No. 5,987,407 issued to Wu et al on Nov. 16, 1999 and the white paper by Rod Elliott, entitled "Soft Clipping," published on a web page created 15 Apr. 2006, at www.sound.westhost.com/articles/soft-clip.htm, discussing soft-clipping technologies. These documents are hereby incorporated herein by reference, and their implementations may be used herein, provided that the clipping levels are tailored in the manner described in the previous paragraph. Mr. Elliott notes in his white paper, however, that the diode clipping circuit introduces some harmonic distortion even at relatively low signal levels.

Figure 4:
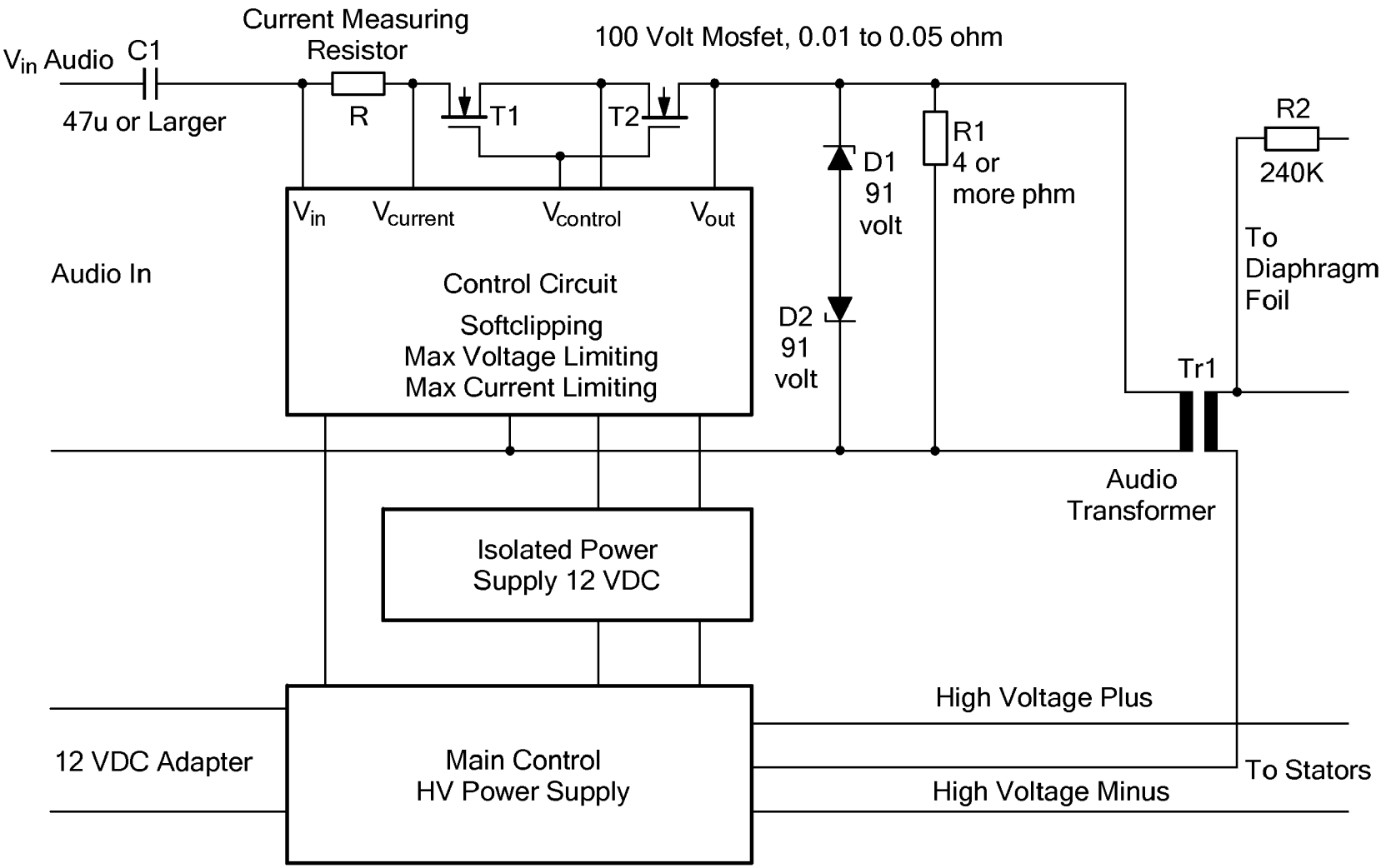
FIG. 4 is a schematic of soft-clipping protection circuitry of an electrostatic speaker according to an embodiment of the invention.

One embodiment of the invention herein providing soft-clipping protection circuitry particularly tailored to electrostatic speakers is schematically shown in FIG. 4, which utilizes MOSFETs instead of diodes in the foregoing white paper. An exemplary embodiment of a control circuit portion of the protection circuitry is shown in FIG. 5.

Figure 5:
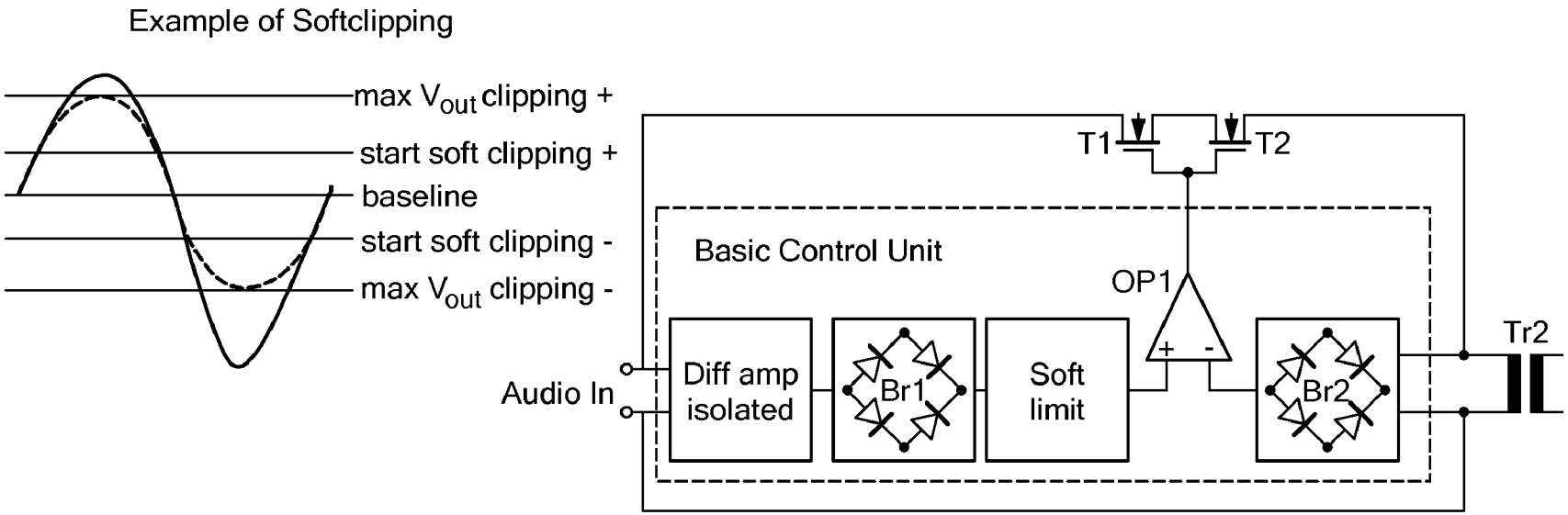
FIG. 5 shows a schematic of the control circuit portion of the protection circuitry of FIG. 4.

Referring now to the left-hand portion of FIG. 5, a set of curves illustrates the handling of audio signal levels by the soft clipping circuit. The thin curve indicates the signal level before soft clipping, and for purposes of illustration, the signal is shown as a sine wave having an amplitude rising above the level (identified as "max Vout") deemed appropriate for handling by the electrostatic speaker. The thick curve indicates the signal level after soft clipping. The two curves are coincident until the signal reaches a level (identified as "start soft clipping), at which point the soft-clipped output is subject to attenuation. The extent of attenuation (relative to the unclipped signal) is increased gradually as the level of the unclipped signal increases in amplitude. Thus, in embodiments herein, soft-clipping operates by introducing a signal-level-dependent gain and gradually attenuating the input audio voltage $V_{in}$ of FIG. 4 to limit the audio level provided to the electrostatic speaker. As a result, a soft-clipped signal does not exceed a pre-determined extreme value of output voltage $V_{out}$ of FIG. 4 that is supplied to the audio transformer of the embodiments of the electrostatic speakers of the invention. For example, a 50 volt limit for $V_{out}$ may result in a maximum voltage between the diaphragm foil and the stator of about 10 kV. In some embodiments, soft-clipping protection may be activated when the input voltage reaches about 60% to 70% of the pre-set maximum of $V_{out}$.

The use of MOSFETs offers several advantages over the relay employed in Our Prior Application:

- the audio signal does not have to be switched off for about a few seconds (as traditionally implemented in the art with the use of a relay), but is only limited for the duration of the peak, which is about a few milliseconds;
- the operation of the MOSFET is very fast and therefore all peaks of the input signal will be attenuated. In comparison, a relay is relatively slow and the signal peak will have already occurred before the relay becomes operational, leading to a short overload
- a MOSFET scheme does not employ a mechanical contact that a typical relay would utilize to switch an inductive load;
- the resistance of a MOSFET is highly linear at the low signal levels. For example, MOSFETS currently utilized in the art provide for minimum resistance on the order of 0.05 Ohm. As a result, parasitic voltage between electronic contacts in the circuitry, known to affect the quality of reproduced audio signal, is optimized in a MOSFET-based scheme Embodiments of soft-clipping circuitry of the invention allow for attenuation of AC signals by providing a control that operates on current in both directions. Moreover, here, the clipping also limits maximum current as well as maximum voltage. FIG. 4 presents a schematic of the overall soft clipping circuit in context. The right-hand portion of FIG. 5 provides detail of the control circuit box of FIG. 4, showing also how the control circuit relates to the pair of MOSFETs T1 and T2. As shown in the example of FIGS. 4 and 5, two anti-serial MOSFETs T1 and T2 are normally fully conducting when an input voltage $V_{in}$ is below a pre-set soft-clipping threshold. Lowering the gate-source voltage with the use of $V_{control}$, which is generated by the control circuit, simulates a rapidly upward adjusted AC-resistor, so that attenuation is produced when the signal levels exceed the threshold. The current is measured with the use of a small resistor R, and the measured current is used to achieve soft-clipping that effectively limits the maximum current. In fact at high frequencies the impedance of an electrostatic speaker can be very low and the current is limited to prevent damaging the conductive diaphragm foil itself.

The right-hand portion of FIG. 5 illustrates operation of the control circuit of FIG. 4. The voltage applied to the gates of MOSFETs T1 and T2 is supplied by the output of an op am OP1. The op amp OP1 receives as one of its inputs a reference signal from a soft-limiter (which may be implemented using Zener diodes) coupled through the diode bridge BR1 and an isolating differential amplifier to the audio input. (The reference signal is related to the amount over which the audio input exceeds a threshold.) The other input to the op amp OP1 is from the diode bridge BR2 coupled to the output signal, which also reflects soft clipping. The output of the op amp OP1 is an error signal used to control the MOSFETs. This circuit has the effect of limiting the loop amplification of the system and provides effective soft limiting.

Switching-off of the audio signal in case of emergency may be implemented with the use of a main control to switch off the MOSFETs. In addition, a programmable measuring loop may be employed to constantly appraise the temperature of the MOSFETs that is known to increase at high audio-signal levels. Whenever the temperature exceeds a safe limit, the MOSFETs may be switched off to cool, interrupting the audio signal and protecting the circuitry.

It should be appreciated that in some embodiments other features of protections and safety for the electrostatic speaker protection feature, including soft-clipping, may be also realized using microcontrollers or other microprocessor-based systems running suitable programs. For example, monitoring of potential leakage of the stator plates of the embodiment of the speaker may be implemented using a safety-protection feedback loop and a computer program code designed to switch off a power supply once a stator-plate leakage has been detected. Additionally, all filter and timing settings in the protection circuitry may be pre-programmed. A schematic example of the circuitry of an embodiment providing such programmable advanced protection feature is presented in FIG. 6. As shown, the Control and Protection block (the CP-block) of a microprocessor-based advanced protection system operates together with the module responsible for tracking a possibility of audio overload (shown as the Audio overload detection module) and imposes maximum permissible levels of operational voltage and current serving as references for soft-clipping of the audio signal, with the soft clipping operating in the manner as described in connection with FIGS. 4 and 5. The same CP-block, overseeing the performance of high-voltage power supply, receives a number of inputs, including the HV+ and HV− voltages from the HV power supply providing a DC output (the values of which are regulated by the HV control output from the CP-block to the HV power supply), as well as the leakage detect signal (which indicates the presence, for example, of stator-diaphragm leakage), in response to which the CP-block generates an appropriate change in the HV on/off output to shut off the HV power supply in the event that unacceptable levels of leakage have occurred. Additionally, the CP-block receives a signal from the Audio low level detection module, which may be used to disable the HV power supply via the HV on/off control line in the event no (or at least below-threshold) audio signal is present, so that the speakers are unpowered when not being used. Similarly, the CP-block has an output used to switch off the audio to the speaker under appropriate conditions, such as an extreme audio overload, as determined by output of the Audio overload detection module. We next describe an interface and typical parameters for implementing this advanced protection.

Programmable implementation of overvoltage protection of electrostatic speakers in the current embodiments dispenses with a conventionally used "in real time" change of electronic components. Instead, embodiments of the system of the invention incorporate an interface including a serial RS232 interface and a programming interface. The programming interface that allows for pre-programming the microcontroller, while the serial interface facilitates a set-up and change of various parameters as well as programmable monitoring the operational parameters of the circuitry. In addition or alternatively, a USB or other type of interface, such as wireless interface (using a standard such as IEEE 802.11(b) or (g)), can be implemented in another related embodiment of the protection and control systems, including control and update of software for the electrostatic speakers.

Operational parameters of the electrostatic speaker system of the invention that are adjustable and programmable with the use of a microcontroller may include:

1. Low level of audio signal (switch high voltage off when no audio is present for a certain amount of time):
   - time constant average audio (1 to 100 msec)
   - trigger level (0.5 tot 400 mV)
   - duration of audio not present before HV switch off (1 sec to about 2 hours)
   - enable/disable function 2. High level of audio signal (switch audio off via relay over a period of time on the order of 15 to 20 msec):
   time constant average (1 to 100 msec)
   trigger above 40 volt level (10 mV to 5 Volt)
   duration of audio switch off (1 to 60 sec)
   enable/disable function
3. Leakage detection (switch off the power supply when the difference current between the + and – of high-voltage supply is detected; also measures the presence of excessive voltage due to audiosignal on the stators):
   time constant average (1 to 100 msec)
   trigger between 0 and 5 volt (about 60 to 100 uA)
   duration of audio switch off (1 to 60 sec)
   enable/disable function
4. High voltage level detection
   time constant average (1 to 100 msec)
   trigger level (0V to 5000 Volt)
   enable/disable function, but function is always disabled at the moment.
5. High voltage setting (may be provided as an option to either use the on/off switch to enable/disable, or to use the PWM output):
   set a pulse-width modulation (PWM) output to set the high voltage up to 4500 volt.
   enable/disable high voltage
   enable/disable high voltage function If implemented as the on/off switch, the embodiment would work faster and save power if 12 adapter voltage is switched off. In comparison, the PWM function gives a slower on/off of high voltage.

6. Audio relay:
   enable/disable relay
   enable/disable relay function
7. Calibration parameters (to enable the use of low cost moderate accuracy components most measured values can be calibrated for optimal accuracy):
   calibration of reference voltage ad converters
   calibration of adaptor voltage divider
   calibration of high voltage plus
   calibration of high voltage minus
8. General parameters such as
   Measuring speed can be set from 0.5 msec to 10 msec. (measuring base clock)
   serial number
   software version
   pcb version
   production date
   last field change data
   parameter version
   other optional values In addition, numerous parameters may be read and monitored using the same microcontroller circuitry:

Low level of audio signal (signal, signal average, time constant, trigger level, value of switch off timer before switching off high voltage, enable/disable function, function status);

High level of audio signal (at least the same parameters as those for the low level of audio signal);

Leakage detection (signal, signal average, time constant, trigger level, value of switch off timer before action/switch on of audio, read enable/disable function, status of function);

High voltage level detection (at least the same parameters as above);

High voltage setting (high voltage PWM settings, enable/disable high voltage, enable/disable high voltage function);

Audio relay (enable/disable relay, enable relay function);

Calibration parameters (calibration of reference voltage ad converters, calibration of adaptor voltage divider, calibration of high voltage plus, calibration of high voltage minus)

General parameters (measuring clock speed, serial number, software version, pcb version, production date, last field change data, parameter version, other optional values).

The microcontroller may be additionally configured to provide for a well-controlled power shut-down process by engaging, for example, an extra capacitor when monitoring the adapter voltage indicates that a power shut-off is imminent. Microcontroller may also be employed to count parameters that provide insight into the operational history of the electrostatic loudspeakers (such as number of errors due to audio-signal overload, or number of leakages, or power on time), and save this during power down in a permanent memory of the system.

Electrostatic Speaker With Angular Arrangement

As will be appreciated by a skilled artisan, a flat panel electrostatic speaker generates sound as a dipole. A dipole can be described as a bi-directional source comprising two point sources (which, as applied to the flat-panel electrostatic speaker, will correspond to the front and back sides of the speaker) separated by distance D (corresponding to a separation between the front and back sides) along the dipole axis and operating with 180° phase difference. At low frequencies, the spatial pattern of acoustic radiation is known in the art to have the appearance of a figure "8". The normalized transfer function H(D/λ), where λ is a wavelength of interest, and the polar directivity pattern R of a dipole are expressed, as functions of angle of radiation at the wavelength λ with respect to the dipole axis, with formulae (1) and (2) and shown in FIGS. 7B and 7C $$|H(D/\lambda)| = 2\cdot\sin\left(\pi\frac{D}{\lambda}\cdot\cos(\theta)\right) \tag{1}$$

$$R(\theta) = \sin\left(\pi\frac{D}{\lambda}\cdot\cos(\theta)\right) \tag{2}$$

Typical dipole characteristics comprise a 6 dB/octave decay for frequencies D/λ<0.5 and local minima of normalized transfer function |H(D/λ)| at D/λ=1, 2, 3, . . . N. At low frequencies, as we have said, the spatial pattern of acoustic radiation assumes the look of a figure "8". Typically, a bidirectional radiating pattern of a dipole is restricted to frequencies D/λ<0.7 It follows from equations (1) and (2) that increasing the distance D between the two point sources forming the dipole lowers both the lower and the upper limit of the bidirectional operating range.

Figure 7C:
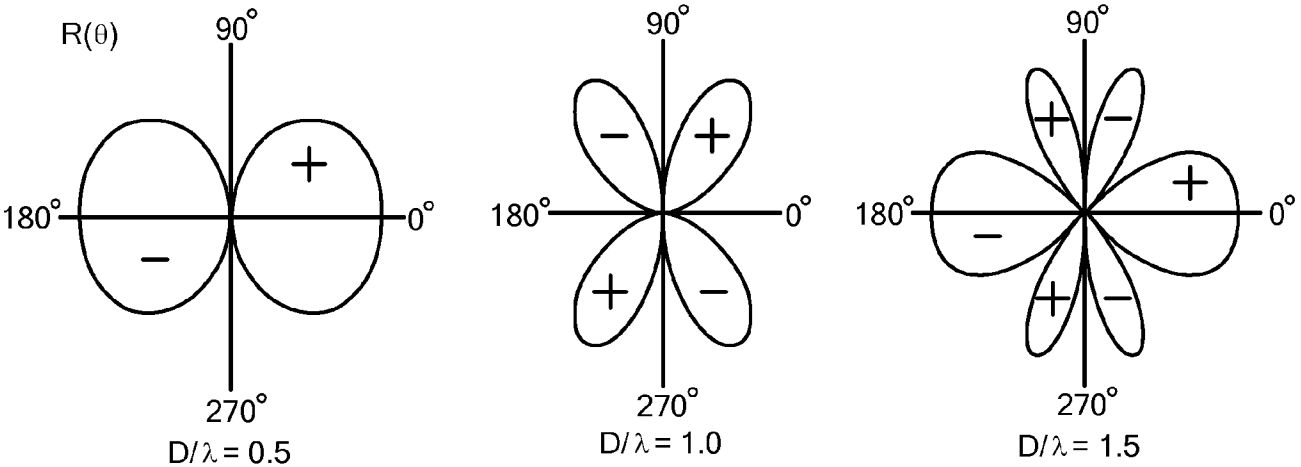

As polar plots of FIG. 7C demonstrate, by depicting examples of radiation patterns of a dipole in different frequency ranges, at frequencies D/λ exceeding approximately 0.7 the dipole develops a multi-polar radiation characteristic with the number of lobes increasing by 4 D/λ. It will be appreciated by a person skilled in the art, that such a multipolar distribution of acoustic radiation effectively degrades the performance of the electrostatic speaker because the acoustic waves are not directed towards the audience in a focused, efficient way. As we demonstrate below, by separating the speaker areas corresponding to low- and high frequency ranges and positioning these areas asymmetrically with respect to the room it is possible to optimize the performance of the speaker.

Figure 8:
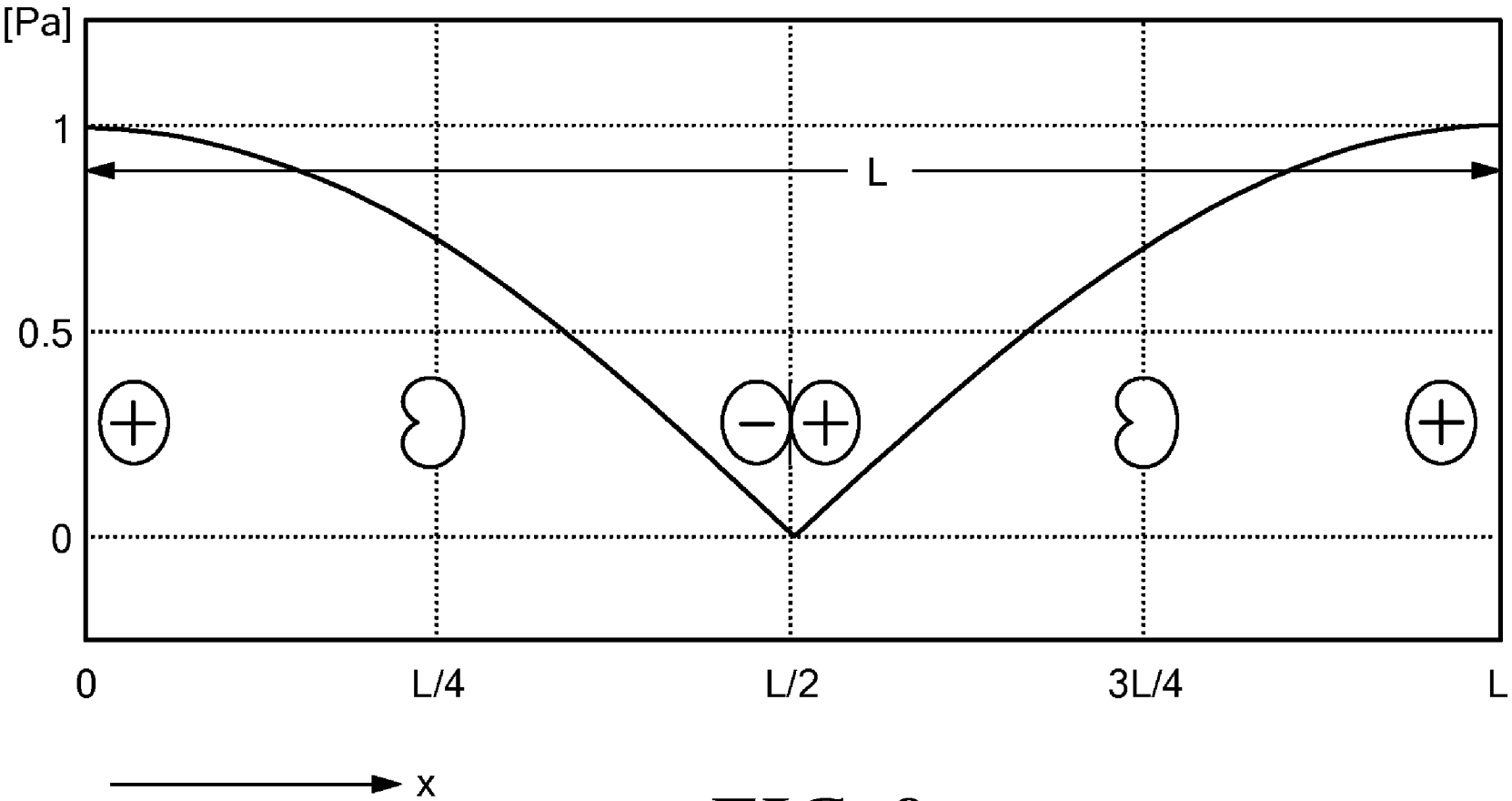
FIG. 8 provides a schematic of a distribution of air pressure, in a room of length L, that corresponds to the lowest one-dimensional acoustic mode of sources with monopole, dipole, and cardioid pattern of radiation positioned in different places along the room.

In practice, loudspeakers are not used in free space but are placed in a room (of length L), often in proximity to walls. In such environment, the acoustic waves generated by the speaker interact with walls and excite acoustic modes of the room. As will be readily appreciated by a person skilled in the art, the acoustic modes of the room have substantial influence on the quality of sound in the room, especially in the sparsely modal frequency range. Good coupling between the dipole radiation and the room modes, therefore, is required. Such efficient coupling may be achieved by positioning a dipole-like-radiating electrostatic speaker at location of nodes of air-pressure distribution in the room (corresponding the locations of positions of creasts of the velocity distribution). In FIG. 8, demonstrating a one-dimensional example of the lowest acoustic mode of the room, such position corresponds to the pressure-node at x=L/2. To optimize the coupling between the dipole radiation and this mode, the dipole-axis needs to be aligned with the direction of propagation of the acoustic wave in the room mode (x-axis in FIG. 8). It will be appreciated that turning the dipole-axis away from the axis (which would correspond to turning the speaker away from the audience and towards the side wall of the room) by an angle A reduced the coupling into this one-dimensional room mode. In the extreme case of A=90° (a speaker faces the side wall), no coupling into this one-dimensional mode will occur.

Figure 9:
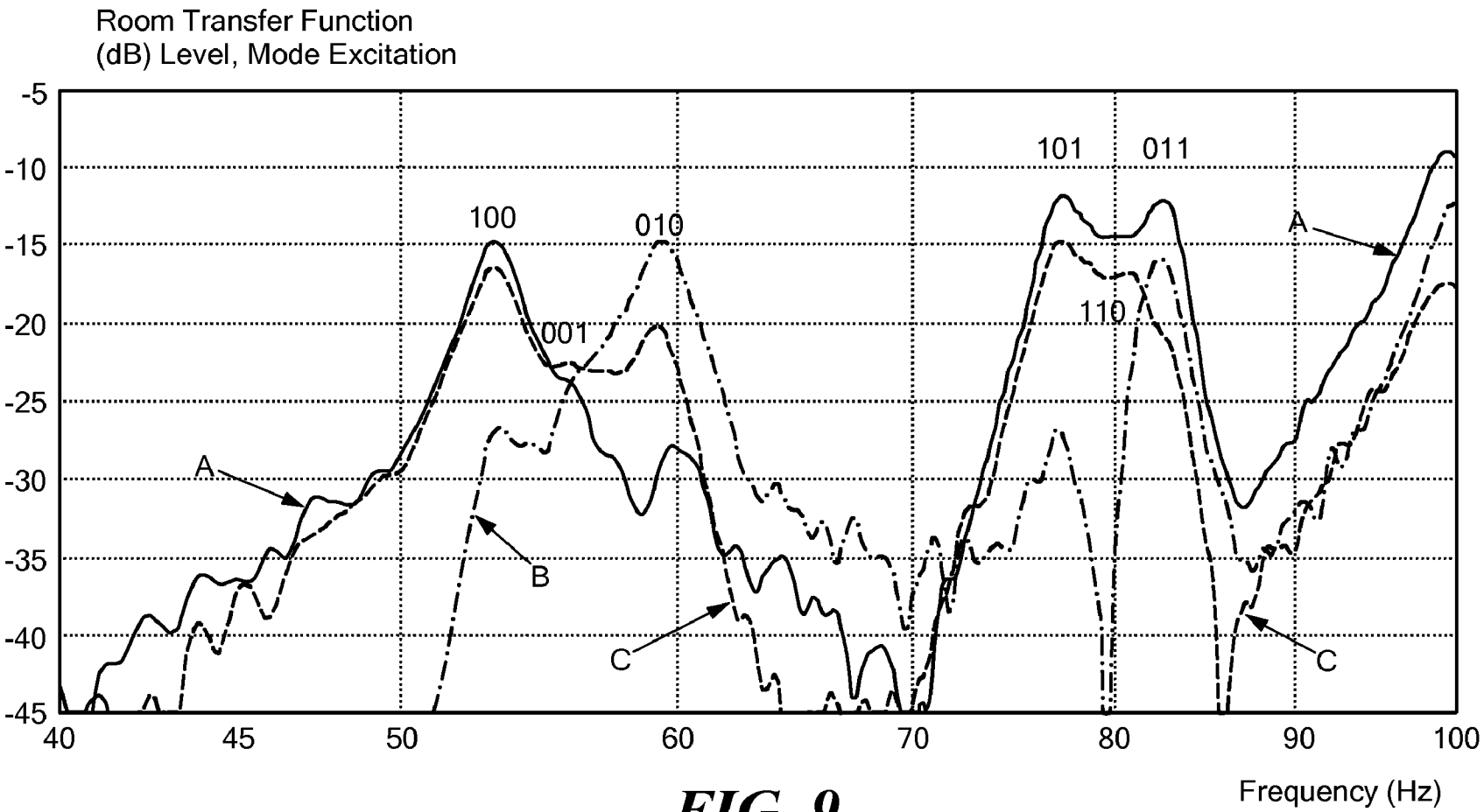
FIG. 9 illustrates the effect of excitation of acoustic modes of the room, at different frequencies, with a dipole as a function of the angle $\theta$ between the dipole-axis and a direction of elongation of the room FIG. 10 schematically shows a top view of an embodiment of an electrostatic speaker comprising two sections inclined at an angle with respect to one another, with a high-frequency section disposed parallel to and away from the front wall of the room.

In a real, three-dimensional room the dipole source has to efficiently excite, of course, three-dimensional acoustic modes of the room to create an efficient in-room transfer-function without gaps. Our research unexpectedly demonstrated that optimization of excitation of the three-dimensional acoustical modes in the room at all available frequencies may be achieved by separating a low-frequency portion of a flat-panel electrostatic speaker from a high-frequency portion, followed by positioning these two portions at an angle to one another. FIG. 9 illustrates the effect of excitation of acoustic modes of the room, at different frequencies, with a dipole as a function of the angle θ between the dipole-axis and a direction of elongation of the room (x-axis in FIG. 8). As will be readily apparent from the comparison of the room transfer functions drawn in. FIG. 9 shows the results of measurement of room transfer functions for the first six acoustic modes (100, 001, 010, 101, 110, and 011) conducted in a reverberation room. The exemplary results correspond to (A) dipole-axis being parallel to the x-axis (i.e., dipole is aligned with the length of the room, which corresponds to the electrostatic speaker facing the audience), (B) dipole-axis being perpendicular to the x-axis (i.e., the speaker is facing the side wall), and (C) dipole-axis being parallel to the bisector of the room corner (or, differently put, being oriented at 45 degrees with respect to the front wall). As will be readily apparent from FIG. 9, inclination of the speaker with respect to the side walls of the room optimizes the shape of the transfer function at low frequencies by substantially eliminating the gaps in the transfer functions. Consequently, positioning the low-frequency portion of the speaker at an angle with respect to the high-frequency portion of the speaker, which faces the audience, may allow for optimized coupling between the low-frequency sound generated by the electrostatic speaker and the room modes.

Figure 10:
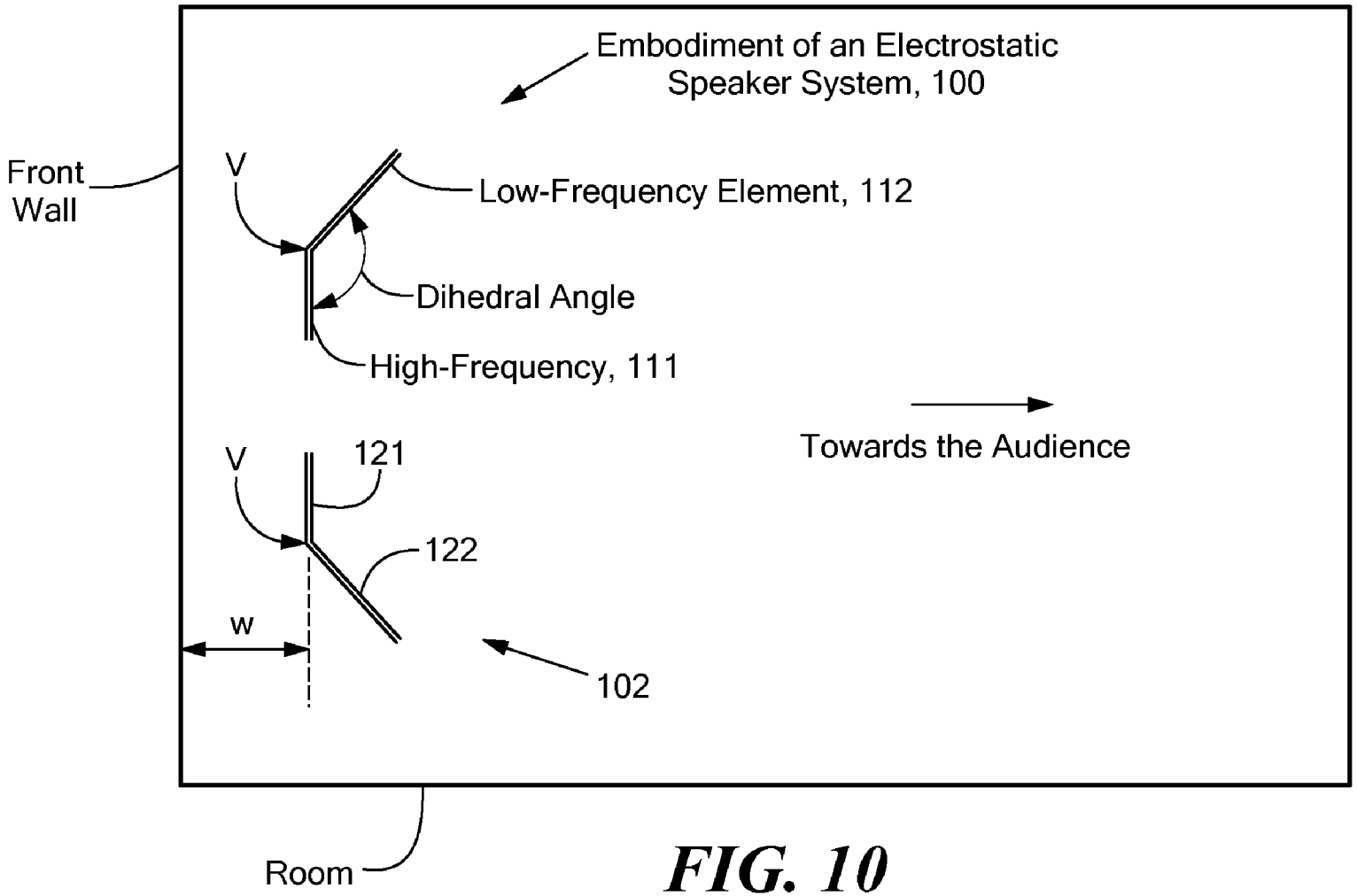

An example of such embodiment is presented in top view in FIG. 10, where a pair of electrostatic speaker systems, each speaker system including two distinct elements that respectively generate of high-frequency tones (in response to a suitably filtered input) and mid- and low-frequency tones (also in response to a suitably filtered input), disposed at a distance w away from the front wall of the room. The speaker systems in FIG. 10 are shown as items 100 and 102. The high frequency elements are items 111 and 121 respectively, and the low frequency elements 112 and 122 respectively. For each element 111, 112, 121 and 122, a surface of the diaphragm of the element defines a plane for the element. As shown in FIG. 10, for each speaker system 100 and 102, the elements are mounted in a structure with respect to each other so that their planes form a dihedral angle. In this embodiment, the dihedral angle is variable so that the speaker elements can be adjusted at an angle relative to one another according to environmental characteristics of a room in which they can be situated. Furthermore, at the vertex V of the angle of the elements of each of the speaker systems 100 and 102, the structure includes a piano hinge to implement adjustment of the angle while maintaining integrity of the structure. The structure optionally includes a clamp to fix the dihedral angle at a desired setting for the room. By using the word "clamp", we refer here and in the claims to any arrangement by which further adjustment of the angle may be prevented, so that a desired adjustment of the angle may be preserved. Thus a clamp may include a conventional pressure clamp applied axially to the hinge to establish friction to freeze the hinge position as well as, for example, an alternative arrangement such as a spring-loaded ball and detent arrangement by which the position of each element may be frozen relative to a base on which the elements rest.

It will be appreciated that, in specific embodiments of the invention, a speaker may generally comprise a plurality of sections or portions consisting of more than two portions, each portion generating sound within a respective frequency band, the portions being disposed at judiciously chosen angles with respect to one another and to the fiducial direction in the room so as to optimize the efficiency of coupling between the sound waves generated by the speaker and the acoustic modes of the room.

Figure 11:
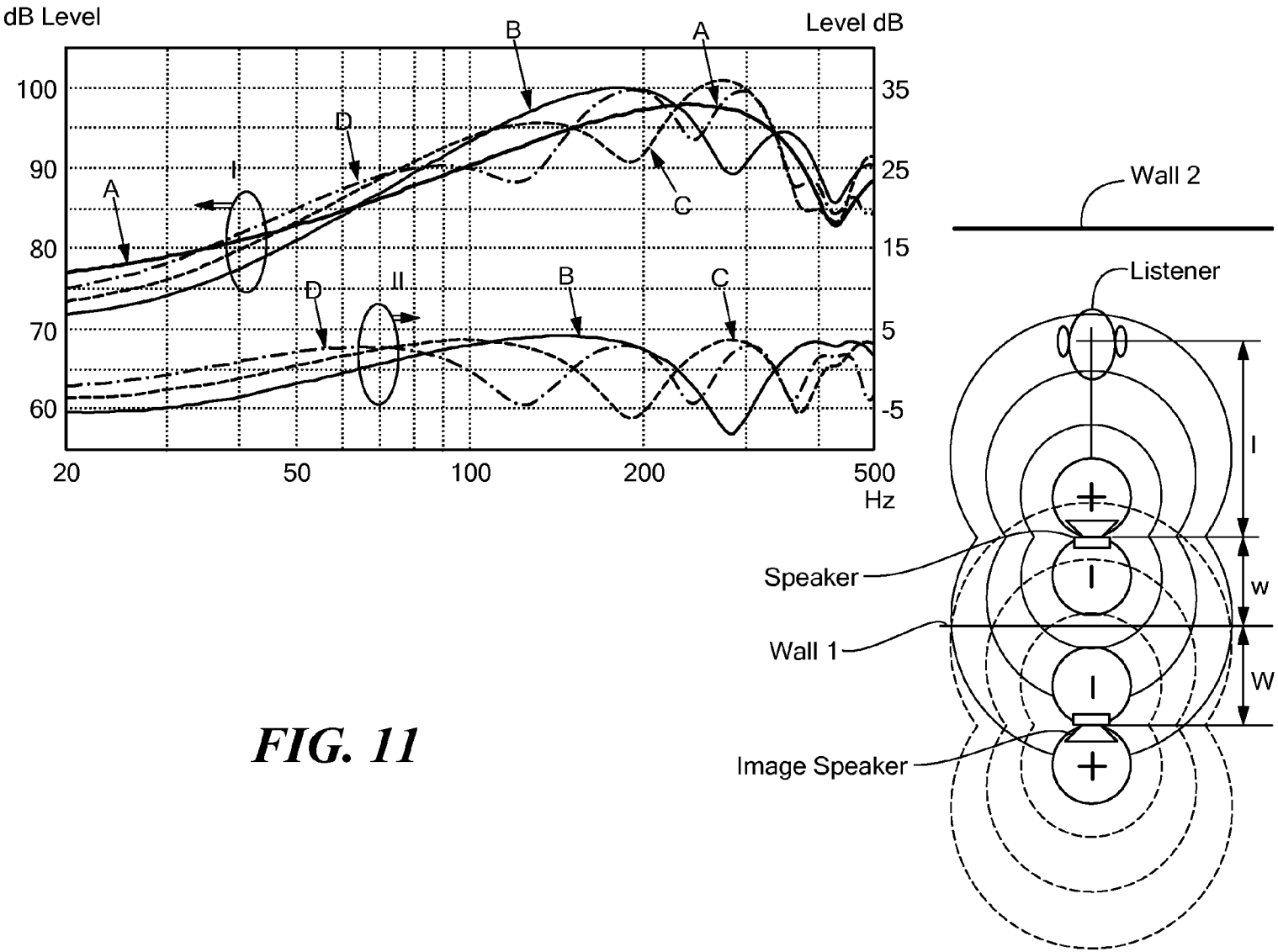
FIG. 11: Group I: An exemplary on-axis frequency response of a dipole radiating (A) in free-space, and in front of the wall that is perpendicular to the dipole axis at a distance of (B) w=0.2 m, (C) w=0.5 m, and (D) w=1.0 m. Group II: traces (B), (C), and (D) normalised to the free-space response (A).

Electronics User Interface, Digital Filtering, and Compensation for Room Acoustics As will be readily understood by the one skilled in the art, room acoustics—stemming from the presence of reflective surfaces in the room—significantly affects the room transfer function. For example, if a reflective surface is parallel to the axis of a radiating dipole (i.e., normal to the front facet of the electrostatic speaker), less energy is reflected (because of the pressure-node of the dipole). To the contrary, the influence of an acoustically reflective surface (such as a wall 1 of FIG. 11) located directly behind, at a distance w, and parallel to the electrostatic speaker may be accounted for my considering a phantom source—an "image" of the speaker with respect to the wall. FIG. 11 shows, as a function of acoustic frequency, the on-axis frequency response of the dipole (representing a flat panel electrostatic speaker) for the cases of (A) a dipole in free space and the interference between the waves emanating from the speaker and those emanated waves that have been reflected by the wall 1 located at (B) 0.2 m, (C) 0.5 m, and (D) 1.0 m behind the dipole. Clearly, then, the unequal attenuation of various frequencies due to the interference impairs the performance of the speaker. In addition, as will be appreciated by a skilled artisan, with increase in height of the flat panel speaker the distribution of sound in the vertical dimension becomes more and more directional at higher frequencies.

Therefore, the room surfaces that affect the performance of the flat panel electrostatic speaker the most are the frontwall behind the speaker, the backwall behind the listener (walls 1 and 2, respectively, in FIG. 11), and the surface of the floor. Under normal operating conditions, the speaker is positioned closer to the frontwall thus making parameter w to be an important consideration in implementing an electronic compensation of the room acoustics. As we discuss in Our Prior Application in connection with FIG. 38 through the end of the application, amplifiers may include compensation for effects of the room in which the electrostatic speakers are placed. Electrostatic speakers have a characteristic, different from enclosed cone speakers because electrostatic speakers radiate sound from the back as well as from the front, and the backward-directed radiation, reflected from the back wall, (among other things) contributes to a sound pattern that is considerably different from the pattern of enclosed cone speakers.

Provided that the positioning of a flat panel electrostatic speaker in a typical room as well as the listening distance (distance l in FIG. 11) is estimated, an embodiment of the present invention compensates for these effects by providing an average electronic compensation of the phantom source attributable to the speaker and, therefore, improves the room transfer function. Such electronic compensation, being frequency dependent, is here implemented with digital bi-quad filters in an audio-video receiver (AV receiver) having outputs for connection to electrostatic speakers (and, optionally, one or more cone-speaker subwoofers). Of course, although we describe the embodiment in terms of an AV receiver, related embodiments may be implemented in any electronics system including an amplifier with an audio output for connection to one or more electrostatic speakers. The amplifier may include a class D output as described in Our Prior Application at pages 36-38, and compensation may be introduced using the digital signal processor 427 of FIG. 42 (even without necessarily using a diaphragm position detector 428).

In specific embodiments of the present invention, parameters of compensation systems implemented in the AV receiver can be varied by the user through a user interface implemented to optimize the performance of the electrostatic system in the local environment. These parameters are designed to take into account the influence of the ambient environment where the system operates, such as, for example, dimensions of a room, or placement of the loudspeakers in the room, or room acoustics. In such specific embodiments, the user may access, through the user interface, a menu (whether graphical or textual) containing a set of choices corresponding to major physical parameters that have been built into the system based on, for example, statistical generalization of known housing construction parameters or furnishings in a typical residential environment, or even a type of speakers used (as specified by the manufacturer). In particular, the parameters are established not by asking the user to specify directly the parameters for the compensation but rather to provide details such as the model number of the speakers, and distances governing placement of the speakers in the room, and these settings are used to establish the parameters of compensation.

A user interface may be implemented in various ways known in the art, for example through a display located in the AV receiver that is temporarily coupled to display user-adjustable parameters of the AV receiver. The user may specify via the interface a discrete distance between the speaker and the front wall behind it (small, medium, large), model of speakers used, or indicate a preferred positioning of the speakers (on wall, on floor along wall, in the corner) in combination with approximate distance to the listeners.

In another embodiment, one of the choices offered by the receiver may be a request for automatic empirical determination of acoustic response of the ambient environment, discussed in Our Prior Application. Additional equalization for rooms with small or large high frequency damping is be useful to improve the tonal balance of such systems in different environments.

Figure 12:
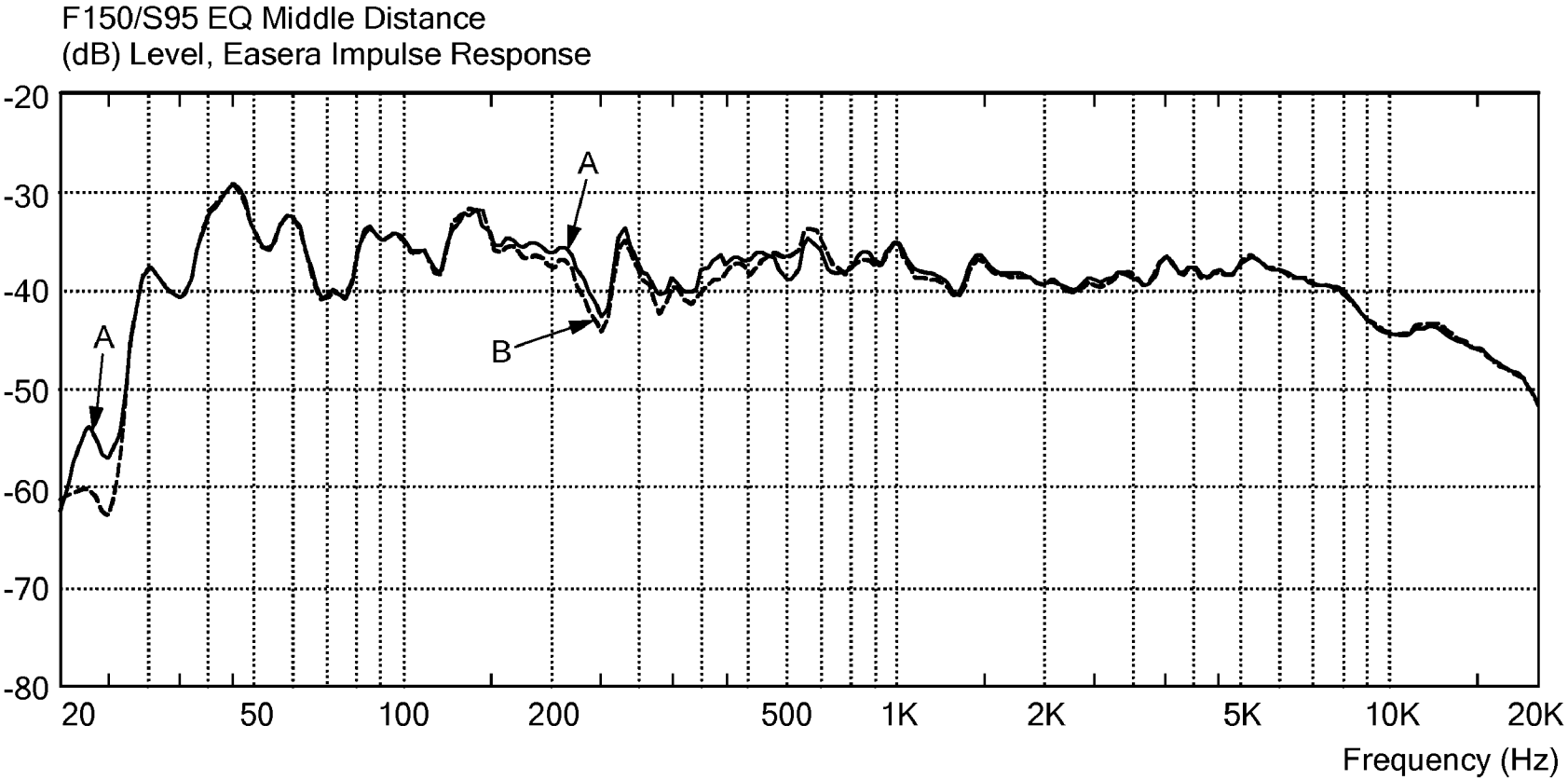
FIG. 12: Room transfer function of a combination model M2 electrostatic speaker with S95 subwoofer: a result of electronic compensation implemented for "middle" wall distance w of FIG. 10 and a correction with a setup of AV-Receiver.
Figure 13:
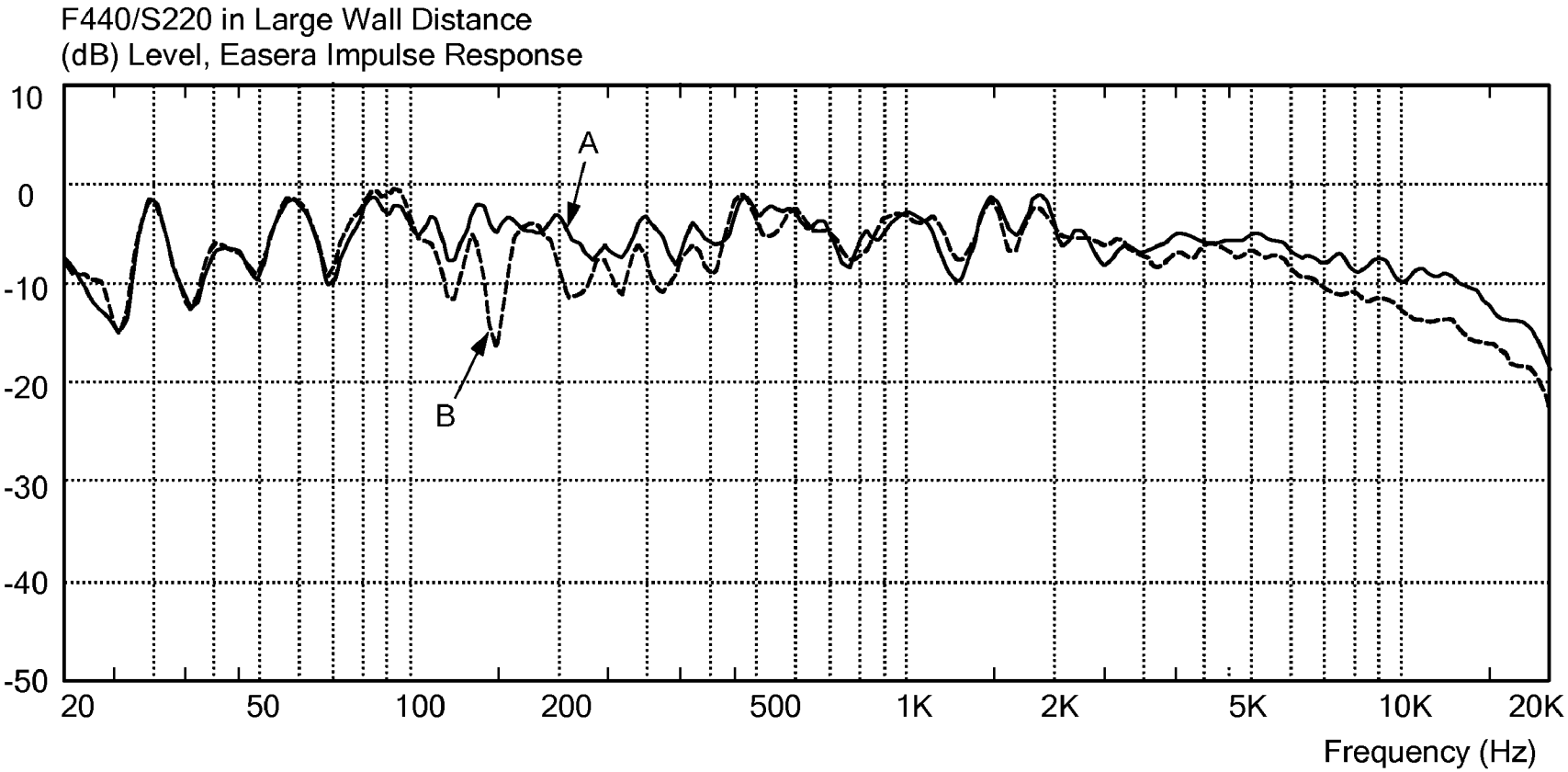
FIG. 13: Room transfer function of a combination model M4 electrostatic speaker with S220 subwoofer: a result of electronic compensation implemented for a "large" wall distance w of FIG. 10 and a correction with a setup of AV-Receiver, right subwoofer allpass, phantom source compensation and high frequency room damping compensation.

FIGS. 12 and 13 show two examples of electronic pre-correction for a speaker-in-the-room with the right setup in the AV-Receiver that improves the room transfer function and, therefore, the quality of the sound delivered to the listener. Curves A in FIGS. 12 and 13 correspond to the room transfer functions without correction, and curves B—with corrections introduced. Exemplary parameters of AV-receivers for speaker models (M1 through M4) are presented in FIG. 14, showing elements of electronic circuitry appropriately set-up in a given model, by using the user interface, depending on the position of the speaker with respect to the front wall and high-frequency room damping.

Figure 15:
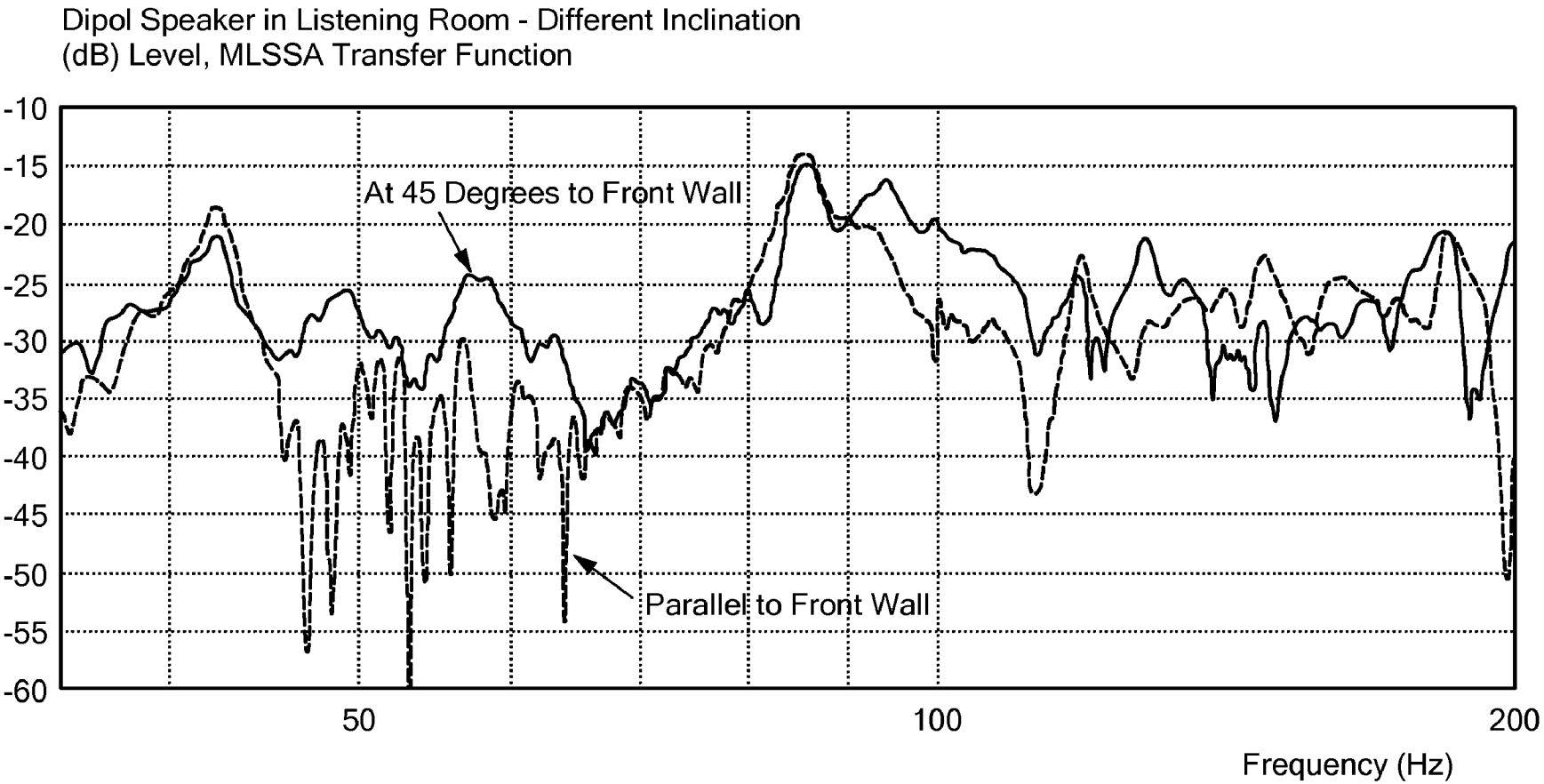
FIG. 15: Room transfer functions representative of operation of a low-frequency section of a dipole-like electrostatic speaker, wherein the low-frequency speaker section is positioned: (A) parallel to the front wall of the room, and (B) at 45 degrees with respect to the front wall of the room.

Some of the design parameters considered in reference to FIG. 14 were as follows: 1) parameters of the filters are related to the character of LSPCAD Bi-Quad digital filters; 2) for speaker model M4, the maximum distance from the front wall is about to 1.7 m; 3) In the highpass/lowpass setup's for each satellite and subwoofer constellation is the fixed second order lowpass (−235 Hz/−3 dB) if the "sub-out" in the receiver is acoustically considered; 4) The given delays for a subwoofer speaker are related to the "origin-position" of the sound source; for example, for Final Sound subwoofer model S220, sound comes from the front of the enclosure, whereas for Final Sound subwoofer model S110 and a small subwoofer, sound comes from the middle of the enclosure. FIG. 15 provides an illustrative comparison between two typical-room transfer functions associated with the performance of a conventional flat-panel (operating dipole-like) speaker. Curve A is associated with the speaker positioned parallel to the front wall of the room, while curve B reflects the situation when the speaker is inclined by 45 degrees with respect to the front wall.

Figure 16:
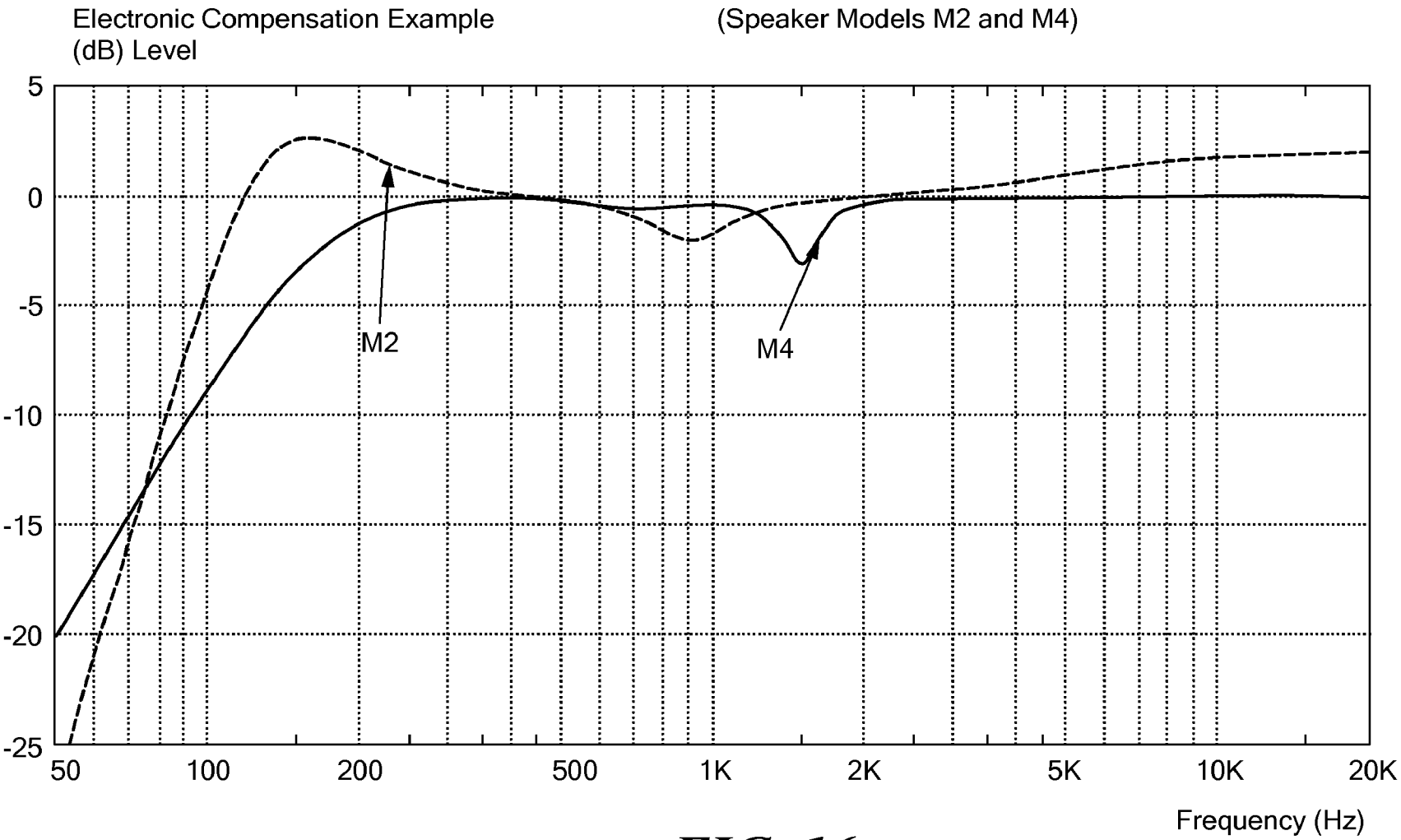
FIG. 16 illustrates correction transfer functions, resulting from activating the electronic compensation, for a dipole-like electrostatic speaker models M2 and M4, in accordance with an embodiment of the current invention, that are disposed parallel to the front wall of the room. Curve M2: electronic compensation in the AV-receiver of model M2 is activated for a "middle" wall distance w. Curve M4: electronic compensation in the AV-receiver of model M4 is activated for a "large" wall distance w.

It would be appreciated that embodiments of electronic compensation may be used for the purposes of balancing the acoustic deficiencies arising, as discussed above, due to reflection of the sound off the front wall. For example, FIG. 16 illustrates correction transfer functions, resulting from activating the electronic compensation, for a dipole-like electrostatic speaker models M2 and M4 of the current invention that are disposed parallel to the front wall of the room (i.e., in the geometry of FIGS. 12 and 13). Here, the curve M2 corresponds to the operation of the model M2 with electronic compensation in the AV-receiver for a "middle" wall distance w (see FIG. 12). The curve M4 describes the correction transfer function to the operation of the model M4 and electronic compensation implemented for a "large" wall distance w (see FIG. 13).

In further related embodiments, in response to the user choices, an appropriate assembly such as compensating network 113 of FIG. 38 in Our Prior Application, responsible for operational integration of the system into the environment, may automatically activate all system components to perform their designated functions in a pre-set fashion statistically optimized to a combination of parameters so chosen. The choice of "on floor along wall" combined with the user-input of an approximate distance of the speakers from the wall may result, for example, in initiating a correction signal to avert phase cancellation effects caused by the reflection of the sound off the wall, while a combination of the acoustic response of the room and room's size will allow to approximate a desired response of the system's amplifier.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. An electrostatic speaker system comprising:

first and second substantially rigid stators and a diaphragm disposed therebetween, each of the stators and the diaphragm having an electrically conductive portion, wherein the stators have a perforation pattern, and wherein the conductive portion of the diaphragm is patterned as a mesh.

2. The electrostatic speaker system according to claim 1, wherein the mesh includes gaps, the system further comprising a conforming layer overlying the conducting portion of the diaphragm, and disposed so as to cover gaps in the mesh.

3. The electrostatic speaker system according to claim 2, wherein the conforming layer is characterized by resistivity of at least $10^8$ Ohms per square or higher.

4. The electrostatic speaker system according to claim 1, wherein the conductive portion of the diaphragm is formed by printing on the diaphragm a conductive ink of having very finely divided conductive pigment particles in a thermoplastic resin.

5. The electrostatic speaker system according to claim 1, wherein the diaphragm has a highly conductive line along the border of the conductive portion of the diaphragm, the highly conductive line formed thereon by printing.

6. The electrostatic speaker system according to claim 1, wherein a first one of a pair of electrostatic speaker elements is coupled to an input filtered to provide audio signals in a first frequency range and a second one of the elements coupled to an input filtered to provide audio signals in a second frequency range, the first frequency range lying above the second frequency range, the conductive portion of the diaphragm of the first element having lower resistance per square than the conductive portion of the diaphragm of the second element.

7. The electrostatic speaker system according to claim 5, the conductive portion of the diaphragm of a first element has a finer mesh pattern than the conductive portion of the diaphragm of a second element.

* * * * *